US007421988B2

(12) United States Patent
Battlogg

(10) Patent No.: US 7,421,988 B2
(45) Date of Patent: Sep. 9, 2008

(54) POSITIVE-GUIDANCE APPARATUS FOR CONVERSION OF A ROTARY MOVEMENT OF A DRIVE TO A RECIPROCATING MOVEMENT OF A PART

(76) Inventor: Stefan Battlogg, Haus Nummer 166, St. Anton im Montafon (AT) A-6771

( * ) Notice: Subject to any disclaimer, the term of this patent is extended or adjusted under 35 U.S.C. 154(b) by 138 days.

(21) Appl. No.: 11/196,673

(22) Filed: Aug. 3, 2005

(65) Prior Publication Data

US 2006/0027194 A1 Feb. 9, 2006

(30) Foreign Application Priority Data

Aug. 3, 2004 (EP) ..... 04018342
Jan. 18, 2005 (EP) ..... 05000881

(51) Int. Cl.
*F01L 1/34* (2006.01)

(52) U.S. Cl. ..... 123/90.16; 123/90.24; 123/90.6; 74/25

(58) Field of Classification Search ..... 123/90.24, 123/90.16, 90.6, 90.15; 74/22 A, 25
See application file for complete search history.

(56) References Cited

U.S. PATENT DOCUMENTS 1,084,514 A * 1/1914 Whitlock ..... 123/87
1,937,152 A 11/1933 Jünk
2,814,283 A 11/1957 Gassman et al.
3,430,614 A 3/1969 Meacham
4,754,728 A 7/1988 Bordi et al.
5,048,474 A * 9/1991 Matayoshi et al. ..... 123/90.18
5,058,540 A 10/1991 Matsumoto
5,931,130 A * 8/1999 Lucarini ..... 123/90.24
6,477,997 B1 * 11/2002 Wakeman ..... 123/90.16
6,705,262 B2 * 3/2004 Battlogg ..... 123/90.26
2003/0029402 A1 * 2/2003 Pomerleau et al. ..... 123/90.18

FOREIGN PATENT DOCUMENTS

| | | |
|---|---|---|
| DE | 37 00 715 A1 | 7/1987 |
| EP | 0 429 277 A1 | 5/1991 |
| FR | 2 817 908 | 6/2002 |
| GB | 19193 | 6/1914 |
| GB | 434247 | 8/1935 |
| WO | 01/12958 A1 | 2/2001 |
| WO | 03/104618 A1 | 12/2003 |

* cited by examiner

*Primary Examiner*—Zelalem Eshete
(74) *Attorney, Agent, or Firm*—Lawrence A. Greenberg; Werner H. Stemer; Ralph E. Locher

(57) ABSTRACT

A positive-guidance apparatus for conversion of a rotary movement of a driven cam element to a reciprocating movement of a part. The apparatus has a first cam area which pushes the part away in a first direction. A second cam area, which is formed on another cam pulls the part back with the aid of a flexible element.

20 Claims, 16 Drawing Sheets

POSITIVE-GUIDANCE APPARATUS FOR CONVERSION OF A ROTARY MOVEMENT OF A DRIVE TO A RECIPROCATING MOVEMENT OF A PART

BACKGROUND OF THE INVENTION

Field of the Invention

The invention relates to a positive-guidance apparatus for conversion of a rotary movement of a drive to a reciprocating movement of a part, in particular of a cam controller, valve drive for internal combustion engines in motor vehicles, or the like.

One major field of use for an apparatus such as this is in the design of internal combustion engines, where the apparatuses that are referred to there as valve drives normally have a spring or the like, by means of which the valve is moved to the closed position. The moving part (valve stem, drag lever, tilting lever or the like) is thereby pushed against a valve control surface, which runs eccentrically with respect to the shaft axis in the cam area. When the valve is being closed, care must be taken to ensure that the valve plate does not strike the valve seat too quickly since, otherwise, it bounces back and the valve "jumps back" into the open position. This requires relatively complex matching between the masses to be moved, the forces that occur, the material characteristics, etc.

Owing to the large number of problems in this matching process, there is therefore also no lack of proposals for positive guidance of the moving part on the cam element, with different embodiments having been developed, each of which is based on a second eccentric valve control surface instead of the return spring. Specific embodiments can be found, for example, in GB 19,193/1913 or GB 434247, wherein the cam element has a groove on at least one end surface, whose two side walls form the valve control surfaces. A roller or the like engages in the groove from one side, and is arranged at the end of the moving part. A cam element which has a web which clasps it is known, for example, from European published patent application EP 0 429 277 (corresponding to U.S. Pat. No. 5,058,540).

Embodiments are likewise known, wherein the valve control surfaces are split into two cam elements, on which two cam follower elements act, which press against the same valve from opposite sides and at least one of which is a lever which is mounted such that it can rotate (for example U.S. Pat. Nos. 4,754,728; 3,430,614; and 2,814,283). The splitting of the valve control surface into two cam elements subdivides the valve travel into functionally associated process elements, which can be better matched to the respective task and to one another: in a similar way to that for valve drives with return springs, the first cam element can be designed for acceleration that is as high as possible, wherein case the first acceleration section can be optimized to the valve travel curve, since there is no opposing spring force.

In contrast to valve drives with return springs, the point of inflection in the open travel curve element indicates a change in function, since only the second cam element operates between this first point of inflection and the second point of inflection on the closing travel curve element. A change in function once again occurs at the second point of inflection, since the first cam element comes into use again during the second deceleration section. Since there is no opposing spring force, the first cam element can also be optimized for the second deceleration and the transition to the closed position.

However, a large amount of physical space is required for the bearing and coupling of the cam follower elements, both in height and laterally.

Particular embodiments of positive guidance can be found, for example, in German patent application DE 37 00 715, international PCT publications WO 01/12958 and WO 03/104618, and from French patent publication FR 2 817 908, in each of which the cam element is surrounded by a flexible surrounding element, which rests loosely on it, and which is connected to the moving part which forms a cam follower element. The cam element thus revolves in the surrounding element. The surrounding element surrounds the circumference of the cam element without any significant clearance, so that it is matched to the cam shape, and the cam element can be rotated in the surrounding element, by virtue of the condition of the surrounding element. Since the cam follower element cannot rotate with the cam element, the movement of the cam area around the rotation axis of the cam element is converted to a travel movement or reciprocating movement of the part which is mounted in the cylinder head such that it can be moved or pivoted. The cam follower element does not carry out any movement provided that the connecting area of the surrounding element to the cam follower element lies on the basic circle area of the rotating cam element, is then moved away from the rotation axis of the cam element in the radial direction, and is finally moved back again, while the cam area of the cam element matches the connecting area of the surrounding element with the cam follower element.

The connection between the surrounding element and the cam follower element is designed to be movable such that the required freedom of movement of the moving part in its sliding or pivoting bearing is ensured. In this case, by way of example, provision is made for the surrounding element to be provided with a bearing sleeve or the like, wherein a bearing journal on the moving part engages.

If a surrounding element is placed around a cam element without any connection capability, it rests on it uniformly everywhere. However, since the surrounding element must be connected to the moving part and forces are introduced or carried away via this connection, the contact is not uniform. As a result of the bearing design in the area of the attachment point, a piece of the surrounding element is at a distance from the circumferential surface of the cam element there. Owing to the changing radius of curvature of the cam circumferential surface, the difference between the lengths of the surrounding element and the circumferential surface of the cam element varies in the area of the attachment point during rotation of the cam element, and this is referred to in the following text as the length error. This length error becomes greater the greater the distance between the surrounding element and the cam contour, which is a result of the bearing sleeve or the like, and the smaller the radii of the cam contour, the greater is the cam travel.

Modern internal combustion engines are intended to achieve a high torque over the entire rotary speed range (for example 100 Nm per liter of swept volume). Large cylinder swept volumes (air and fuel) are required for this purpose, since the torque depends directly on the swept volume. The swept volume is governed by the valve travel, the released valve area (valve diameter), the channel cross section and the flow. The valve travel is geometrically restricted by the piston and by the other valve when inlet and outlet valves are open at the same time. The flow is governed by the unobstructed cross-sectional area, that is to say, even if the valve travel increases, the annular area opened up by the valve plate does not become any larger and no more fresh gas can continue to flow (rule of thumb: maximum valve travel=⅓ of the valve plate diameter). Lengthening of the closing time is also restricted, since this leads to filling losses (fresh gas flows into the exhaust) in the overlapping phase when the inlet and outlet are open at the same time, and if closing takes place too late this leads to reverse flows into the induction system. Long opening times shift the power to higher rotation speed ranges, that is to say the engine loses power (torque) at relatively low rotation speeds, which is not desirable, or is worthwhile only for racing engines.

If the maximum possible valve travel and an ideal opening length are now assumed, then the inlet flow volume can be increased further only by the profile of the valve travel (travel in relation to the cam angle). The process is illustrated graphically on the so-called valve travel curve which, in the theoretically ideal case, is a rectangle. The curve elements for the opening travel and the closing travel are in each case plotted on an ordinate. In reality, the curve elements are higher-order curves and include a point of inflection which, in the case of the opening travel curve element, results from the opening acceleration at the start of the travel having to be converted to an opening delay at the end of the travel. A similar constellation occurs after the maximum, since the closing acceleration at the start of the closing travel has to change to a closing deceleration at the end of the closing travel. The valve travel curve thus comprises a first acceleration section, a first deceleration section, a second acceleration section and a second deceleration section.

In the case of valve drives with return springs, this process is influenced by the spring force, which counteracts the mass force in the acceleration section of the opening travel and the deceleration section in the closing travel. The return spring can be restricted not only to the valve deceleration before full travel and the subsequent valve acceleration at the start of the return travel since, in fact, it is also responsible for the valve being held in the closed position against the valve seat, forming a seal, between the valve travel movements. Normally, permissible opening accelerations are about 20 to 25 mm/rad$^2$ (=approximately 3000 m/s$^2$ at an engine rotation speed of 7000 rpm).

$$\mathrm{mm/rad}^2 = \frac{\mathrm{m}/s^2 \cdot 1000}{\left(\frac{\pi \cdot \text{Engine rotation speed}}{60}\right)^2}$$

and $$\mathrm{m}/s^2 = \mathrm{mm/rad}^2 \frac{\left(\frac{\pi \cdot \text{Camshaft rotation speed}}{30}\right)^2}{1000}$$

If a change is made, then the valve spring—which counteracts this acceleration multiplied by the valve mass plus other oscillating parts—must be designed to be stronger, which results in more surface pressure, alternating torque and load on the valve drive. This is undesirable. The only remaining option for filling the combustion chamber is thus to increase the amount of travel per time or cam angle unit, that is to say the valve must be opened from the valve seat as quickly as possible, wherein case modern engines need to have a travel increase per angle unit of at least 80 to 85 mm/rad$^2$, which corresponds to about 10 000 m/s$^2$ at an engine rotation speed of 7000 rpm. If this is not done, filling and thus torque are wasted.

There are various possible ways to improve the opening accelerations: for example, in the case of a cam element whose convex areas merge directly into one another or are connected by a linear section, the basic circle diameter can be increased. Furthermore, the cam follower element can be provided with a touching roller, thus always resulting in only linear contact. In order to achieve the desired 80 mm/rad$^2$, the radius of the basic cam circle would, however, have to be at least 30 mm, which is not directly feasible for design reasons. Basic cam circle radii that can be implemented are in the range from 15 to 20 mm. This is much too small, since the accelerations are too small with these radii, even when using touching rollers (maximum 50 mm/rad$^2$).

If a touching roller is formed on the cam follower element, then the cam element may have a concave transitional area between the convex basic circle area and the convex cam area, that is to say the basic circle angle and the cam angle are increased as a result of the indentation. A concave transitional area with a radius of curvature of 30 mm increases the opening acceleration for a basic cam circle radius of between 15 and 20 mm to about 60 to 70 mm/rad$^2$. However, the cam follower element must not have an opposing surface that bridges the indentation.

The greatest opening accelerations are achieved with a bucket tappet pick-up or with a sliding drag lever pick-up, since the line of contact between the circumference of the cam element and the probe element is moved, seen horizontally, on the contact surface of the bucket tappet (outward movement extent), which effectively suddenly increases the effective radius of the cam element. 80 mm/rad$^2$ can be achieved with bucket tappets and basic cam circle radii of 15 to 20 mm. A concave transitional area on the cam element and a curved bucket tappet or a drag lever with a curved cam follower surface whose smaller outward movement extent can be compensated for by the lever step-up ratio are in contrast suitable for opening a valve sufficiently quickly. This allows opening accelerations of 20,000 m/s or more to be achieved without major difficulties for Formula 1 racing engines. However, these are designed for a life of only a few hours and a maximum distance travel of 800 km. However, the only way to achieve such acceleration valves for drive engines for daily use is a lightweight design and the creation of the capability to cope with the surface pressures between the parts by considerably reduced forces. This can be achieved only with positively guided apparatuses, without any return springs (valve springs).

For positively guided embodiments with a flexible surrounding element, it can be stated that: the surrounding element naturally likewise bridges a concave transitional area. However, the only way to make use of this is to provide an appropriately long distance to the cam contour at the attachment point by means of a projection formed on the inside of a surrounding element, so that contact with the cam circumferential surface is not lost even in the concave area.

As stated above, however, the magnitude of the longitudinal error is governed by the distance from the attachment point. Furthermore, a surrounding element with a constant length allows at most an outward movement which is governed by the clearance resulting from the length error, and is thus not excessively large. If a surrounding element of variable length, which can be extended at least to a limited extent, is used, then length changes which allow a greater outward movement extent beyond the length error are admittedly possible, but, together with the thermally dependent length changes of the valve, these length changes can lead to interference with operation, particularly during closing. Flattering and bouncing of the valve damage the cylinder head.

SUMMARY OF THE INVENTION

It is accordingly an object of the invention to provide a positively guided or desmodromic apparatus, which overcomes the above-mentioned disadvantages of the heretofore-known devices and methods of this general type and wherein a first cam area, formed on a first cam, pushes the part away and a second cam area, formed on another cam, pulls the part back again with the aid of a flexible element.

With the foregoing and other objects in view there is provided, in accordance with the invention, a positive-guidance apparatus for conversion of a rotary movement of a drive to a reciprocating movement of a part, the apparatus comprising:

a first cam having formed thereon a first cam area disposed to push the part away from a given position;

a flexible element; and a second cam having formed thereon a second cam area disposed to pull the part back aided by the flexible element.

The two cams in one preferred embodiment are provided axially offset on a common mounting shaft, and in particular on an integral cam element. However, it is also feasible to provide the two cam areas on cams which are arranged on two mutually parallel mounting shafts. In particular, the first mounting shaft may then have only cams with first cam areas, and the second mounting shaft may have only cams with second cam areas. The choice and arrangement are governed primarily by the design and physical characteristics.

Use of the flexible element for pulling back leads to an extremely space-saving design, since the flexible element is positioned directly on or adjacent to the camshaft and acts close to the first cam area on the part to be pulled back.

The creation of the cam contours for the first and the second cam area is based on a valve travel curve that is as optimum as possible and preferably initially governs the contour of the second cam area, from which the contour of the first cam area is then derived. In this case, the contours of the two cam areas may be approximately the same, that is to say they differ essentially only in the axial position on the cam element thus resulting in advantages as a result of the capability to provide the first cam area with a concave transitional area. The first cam area may thus have not only a symmetrical shape, but also an asymmetric shape. If the contour of the second cam area is stepped in order to minimize the length error, then the contour of the first cam area and the contour of the second cam area differ considerably from one another.

This results in the following options:

a) Two raised cam areas with similar contours for positive-guidance apparatuses wherein the flexible element in the second cam area is guided over the circumference of the cam element to form a return element which is provided on the reciprocating part.

b) A raised first cam area and a negative second cam area for positive-guidance apparatuses wherein the flexible element is guided between a fixed attachment point on the housing, on the cylinder head or the like close to the bearing of the cam element or its mounting shaft, and a return element which is provided on the reciprocating part.

c) The kinematic reversal of a), with two negative cam areas for positive guides, wherein the flexible element is guided in the second cam area over the circumference of the cam element to a return element which, in this case, is arranged on a "reciprocating" part. (In the case of a valve controller, the valve is pushed to the closed position rather than to the open position.)

d) The kinematic reversal of b), with a negative first cam area and a raised second cam area.

If, on the basis of options a) and c), the flexible element is guided over the circumference of the cam element in the second cam area, then one preferred embodiment provides for the flexible element to be in the form of an endless closed loop which is hooked in on the return element. The loop may in this case be attached to the return element, although an embodiment wherein the flexible element is guided around the return element such that it can move is advantageous.

In this case, the expression "moving guidance of the flexible element around the return element" is intended to mean that the flexible element is not attached to the return element. Since the looping length of the cam element is a multiple of the looping length of the return element, the friction between the circumference of the cam element and the flexible element is also several times greater than the friction between the flexible element and the return element, so that the flexible element moves over the return element. In order to keep the friction on the return element as small as possible, the return element in a first embodiment may have at least one roller, which is mounted such that it can rotate, and in a second embodiment may have a sliding surface. If a roller which is mounted such that it can rotate is used, then it is possible to use a set of rollers of different diameters to compensate for production inaccuracies by in each case installing the roller which fits best. Diameter graduations of, for example, 0.1 mm or 0.2 mm may be provided. One or two further rollers of the return element may be arranged outside the flexible element, such that the transitional sections of the flexible element are curved inwards.

In combination with the flexible element, the advantages include a second cam area which is responsible only for between the points of inflection of the valve travel curve and simplified production of the second cam area, and of the entire camshaft. Since the second cam area in this embodiment does not form a touching surface for a cam follower element, the second cam area, which interacts with the reciprocating part exclusively via the flexible element, requires neither the contour precision of the first cam area nor the same material characteristics. The second cam area may thus also be manufactured from plastic, aluminum or the like, and may be pressed, shrunk or the like onto the mounting shaft. Furthermore, it may also be connected to the first cam area, axially projecting from it.

As already mentioned above in b) and d), the flexible element may also extend between an attachment point close to the bearing of the cam element and the return element through the revolution space of the second cam area. The second cam area thus moves the flexible element outwards, with the flexible element being appropriately curved upwards, so that the distance between the return element and the attachment point is shortened, and the moving part is made use of. This is preferably arranged in such a way that the flexible element can assume a linear extended position once per revolution. One particular advantage of these embodiments is in the installation of a valve drive in the cylinder head: the camshaft can be installed in the normal manner, since there is no need to thread it with closed loops. Despite the flexible element, it is still also possible to provide, in particular, hydraulic valve play compensation.

For conventional valve drives, the first cam area is in the form of a raised positive cam, and the second cam area is an indented negative cam, so that the straight extended position occurs at the most indented point of the negative second cam area, that is to say at the reversal point. The flexible element is curved outwards both in the cam flanks and over the entire basic circle. The extended position of the flexible element corresponds to the maximum valve travel.

The arrangement can be interchanged, for example in the case of tilting lever valve drives, that is to say the second cam area is formed by a raised positive cam, so that the outward curvature of the flexible element opens the valve.

In this embodiment as well, the flexible element can be hooked in at the attachment point and on the return element, wherein case, by way of example, a closed loop can be passed over in each case one pin at the attachment point and on the return element, and at the side on the second cam area. The flexible element may, however, also have a finite length and two ends which are fixed at the attachment point and on the return element.

An element which is in the form of a closed loop is preferably formed from a textile-bonded flat material, in particular a fabric, which has threads whose length is as constant as possible in the circumferential direction, such as strip, belts or the like composed of a steel strip, and possibly also being formed from a cable or a chain. A flexible element with two ends to be fixed can likewise be composed of a textile-bonded flat material, a steel strip or a cable, with the fibers of constant length extending between the two ends. The ends may be thickened and may be inserted into corresponding undercut or conical holders at the attachment point and on the return element. One preferred embodiment of the flexible element with two ends to be fixed provides at least two open-link chains which are connected to one another in an articulated manner and allow deflection by the second cam area. A touching roller for the contour of the second cam area can be provided in the joint.

One further embodiment allows any remaining length error to be compensated for by arranging the return element on the reciprocating part such that it is flexible to a limited extent in the return direction, wherein case, by way of example, it is possible to incorporate the play compensation, as mentioned above, between the return element and the reciprocating part.

A further possible way to compensate for the length error is to provide for the flexible element to have an expansion capability, with a maximum intended expansion being achieved by means of integrated expansion limiting. In the case of a fabric with threads of constant length in the return direction, by way of example, these threads may form the expansion limiting, and are thus of the maximum length. Parallel to its threads, the flexible element contains expandable elastic threads whose unextended length corresponds at most to the minimum length of the flexible element, that is to say such that the length error is compensated for by expansion and contraction of the element. If the unextended length of the expandable threads is shorter than the minimum required length, then the flexible element is continuously prestressed, and this can additionally be used to compensate for the length error, for example, of the reciprocating part with a closing force in the basic circle area—in the case of a valve drive, thus pressing the valve into the valve seat. The closing force can be reduced at the start of the opening process by appropriate shaping of the second cam area, so that the forces during valve operation are small.

Since the contour of the second cam area, which is derived from the valve travel curve, can be changed without having to match the contour of the first cam area, the prestressing of the flexible element can be increased by appropriate shaping of the second cam area at each point of inflection of the valve travel curve, and in particular at its maximum at the transition from the opening movement to the closing movement of the valve, in order to avoid the so-called "springing" of the part, that is to say the loss of contact between the cam follower element and the first cam area. The flexible elastic element can thus also be used to damp oscillations.

The return element, which is provided on the reciprocating part and on which the flexible element acts, is preferably a short distance away from the second cam area, in order to avoid friction between the second cam area and the return element. This distance is in one preferred embodiment governed by the cam follower element which rests on the first cam area and by means of which the reciprocating part is pushed away from the cam element. In this embodiment in particular, there is no need for machining or subsequent machining of the second cam area, that is to say it need be neither hardened nor ground, for example, since it is not touched by the cam follower element.

The cam follower element may be composed of a low-friction material and may have a contact surface which may have convex curvature in order to increase the opening acceleration. The cam follower element may also be in the form of a roller, which is mounted on the return element such that it can rotate. If, as mentioned, the flexible element is guided around a roller which can rotate and the cam follower element is formed by a roller which can rotate, the two rollers are preferably arranged coaxially, and rotate in opposite directions. If it is better for design purposes, each roller may, of course, also be arranged on its own axis, with the axes being arranged at a distance from one another.

Particularly for use as a valve controller for internal combustion engines, an arrangement should be found which produces lateral forces on the valve guide that are as small as possible, thus reducing increased valve stem friction, etc. Thus, according to the invention, two preferred embodiments are possible, specifically a first embodiment wherein the second cam area is arranged between two first cam areas, and a second embodiment with a first cam area which is arranged centrally between two second cam areas.

The first embodiment with two first cam areas is particularly suitable for valve drives with bucket tappets and valve drives with holders for two valves arranged alongside one another.

The two embodiments can advantageously be used for valve drives with drag levers, with design based on particularly space-saving embodiments being provided and the cam follower element being arranged directly on the drag lever and the return element being arranged directly on the valve, which is operated by the free end of the drag lever.

As mentioned, the two cam areas preferably have different contours, with the contour of the second cam area preferably being located outside the contour of the first cam area. This allows advantageous production of a cam element with the two different cam areas by the cam element having a first part arranged or formed on the mounting shaft, which first part has the contour of the smaller, in particular first cam area, over its entire axial length, and with a sleeve then being fitted to the in particular second cam area, which is then longer, with the sleeve having the external contour of the larger, in particular second, cam area and the internal contour of the smaller, in particular first, cam area. The sleeve need only be secured against axial movement, since the cam interlock produces the protection against rotation.

If the contour of the second cam area, which interacts with the flexible element, is larger, than, as already mentioned, there is no need for excessive precision and subsequent machining for the cam surface. Since the positive guidance makes the entire design considerably lighter owing to the lack of return springs, that is to say valve springs in the case of a valve drive, and considerably smaller forces occur and may be coped with, a sleeve which has the second cam area can be pushed, pressed or adhesively bonded onto the first cam area, or can be fixed by means of a pin. If the sleeve is made of plastic, then it can be sprayed on or prefabricated and shrunk on or the like, by injection molding. Each of these types of production makes it possible to produce a somewhat more complicated cam contour for the second cam area without any particular effort, wherein case that surface which interacts with the flexible element can also be matched to it, for example being balled, with edge webs or being indented in a concave shape for centering of the flexible element, with a rubber coating for damping or for compensation for the length error until a closing force, etc, is produced. That area wherein the sleeve is fitted on the first part of the cam element can advantageously be used for mounting the cam element on the mounting shaft, since the attachment point is covered. Both cam parts can also be made use of for attachment.

Other features which are considered as characteristic for the invention are set forth in the appended claims.

Although the invention is illustrated and described herein as embodied in a positive-guidance apparatus for conversion of a rotary movement of a drive to a reciprocating movement of a part, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
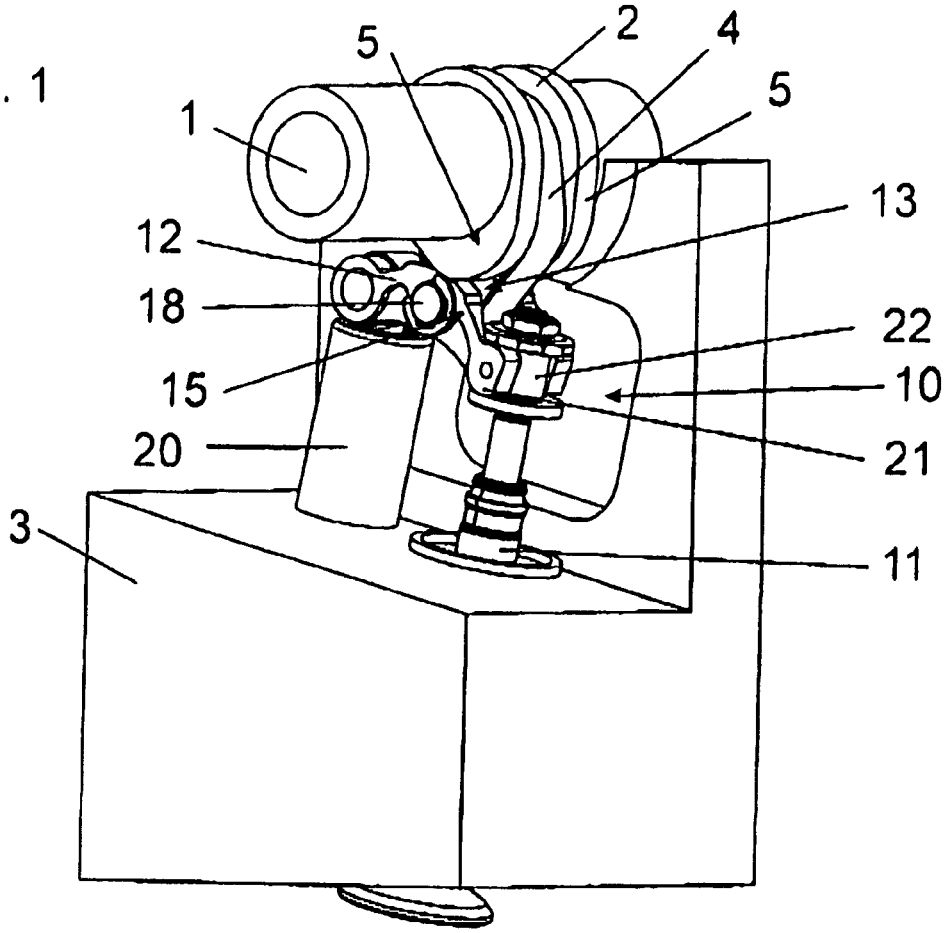
FIGS. 1 and 2 show a first embodiment of a drag lever valve drive with two first cam areas and one second cam area, with FIG. 1 showing an oblique view and FIG. 2 showing a cross section through the second cam area.

Referring now to the figures of the drawing in detail the positive-guidance apparatus according to the invention for conversion of a rotary movement to a reciprocating, linear or pivoting movement, comprises a driven mounting shaft 1 on which at least one cam element 2 is fixed, in a manner which is not shown in any more detail. Each cam element 2 has a first cam area 5 and a second, axially offset cam area 6.

The rotation of the cam element 2 moves a reciprocating part, which is described in a general form by 10, and which is provided with a cam follower element 15, which is associated with the first cam area 5, and with a return element 13, which is associated with the second cam area 6. The first cam area 5 is used for the opening acceleration and for the closing deceleration, and presses directly against the cam follower element 15 during the opening acceleration, which rests with a sliding surface 19 or a roller 17 on the circumference of the first cam area 5. During the closing deceleration, opposite forces occur, that is to say the follow-up element 15 presses directly on the first cam area 5. The axially adjacent second cam area 6 is used to provide the positive return for the part 10 that is being pushed away, by providing the opening deceleration and the closing acceleration which immediately follows this. This is achieved with the aid of a flexible element 4, which acts on the return element 13.

All of the exemplary embodiments show the preferred application of the positive-guidance apparatus, specifically as a valve controller for internal combustion engines. Positive guides such as these may, however, also be used for cam controllers for machine tools, in special transmissions or the like wherein case the reciprocating part 10, which in the illustrated exemplary embodiments comprises a drag lever 12 with a valve 11 or a holder 25 with two valves 11, then being designed as appropriate for the application.

FIG. 1 shows an oblique view of a valve drive with a driven mounting shaft 1 which is mounted in the only schematically indicated cylinder head 3 and has a cam element 2 and an associated valve 11 in the open position. The cam element 2 has three cam areas, which are arranged axially adjacent to one another, with a first cam area 5 being provided symmetrically on each of the two sides of the central second cam area 6. A cam follower element 15 rests on the two first cam areas 5 which have a raised cam contour and is formed by a drag lever 12, which has two mutually parallel webs and is mounted such that it can rotate in a drag lever holder 20 which is arranged, in particular adjustably, in the cylinder head 3. The two webs are each provided with a contact sliding surface 19, with convex curvature, for a first cam area 5. When the cam element 2 is rotated, then the first cam areas 5 pivot the drag lever 12 in the holder 20, and the free end 21 of the drag lever 12 moves the valve 11 to its open position. A sleeve 22 is attached adjustably to the upper end of the valve, which is guided such that it can move in the cylinder head 3, with the free end 21 of the drag lever 12 engaging between the two flanges of the sleeve 22, such that it can move. A return element 13 is provided approximately centrally on the drag lever 12 and is fixed in the webs of the intermediate lever by means of the two projecting ends of a bolt 18. The return element 13 passes through an eye 7 in the flexible element 4, with the flexible element 4 being in the form of a closed loop and surrounding the second cam area 6 of the cam element 2. The contour of the second cam area 6 is located within the first cam area 5, so that the flexible element 4 is held axially between the two first cam areas 5. As a result of the fixing to the drag lever 12, the second cam area 6 revolves within the flexible element 4. The contour of the first cam area 5 is governed by that of the second cam area 6, such that the cam follower element 15 is held resting on the first cam area 5 throughout the entire rotation of the cam element 2. As soon as the tip of the second cam area 6 has passed the eye 7 in the flexible element 4, the eye 7 in the flexible element 4 is moved towards the rotational axis of the cam element 2, with the drag lever 12 being pivoted back and the valve 11 being moved to the closed position, from which it is opened again when the first cam area 5 next passes through.

Figure 3:
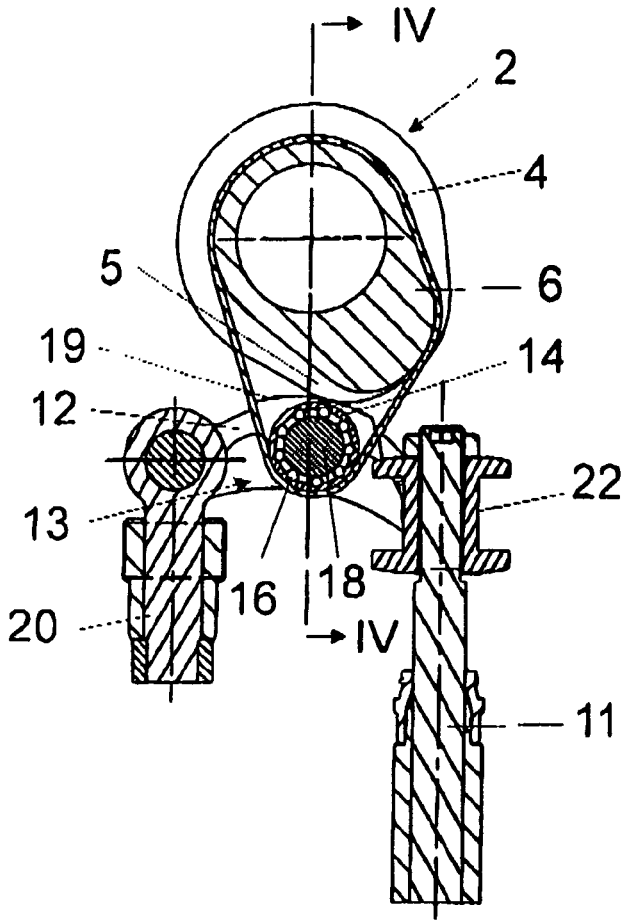
FIG. 3 shows a cross section through the second cam area of a second embodiment, whose oblique view corresponds substantially to that in FIG. 1.
Figure 4:
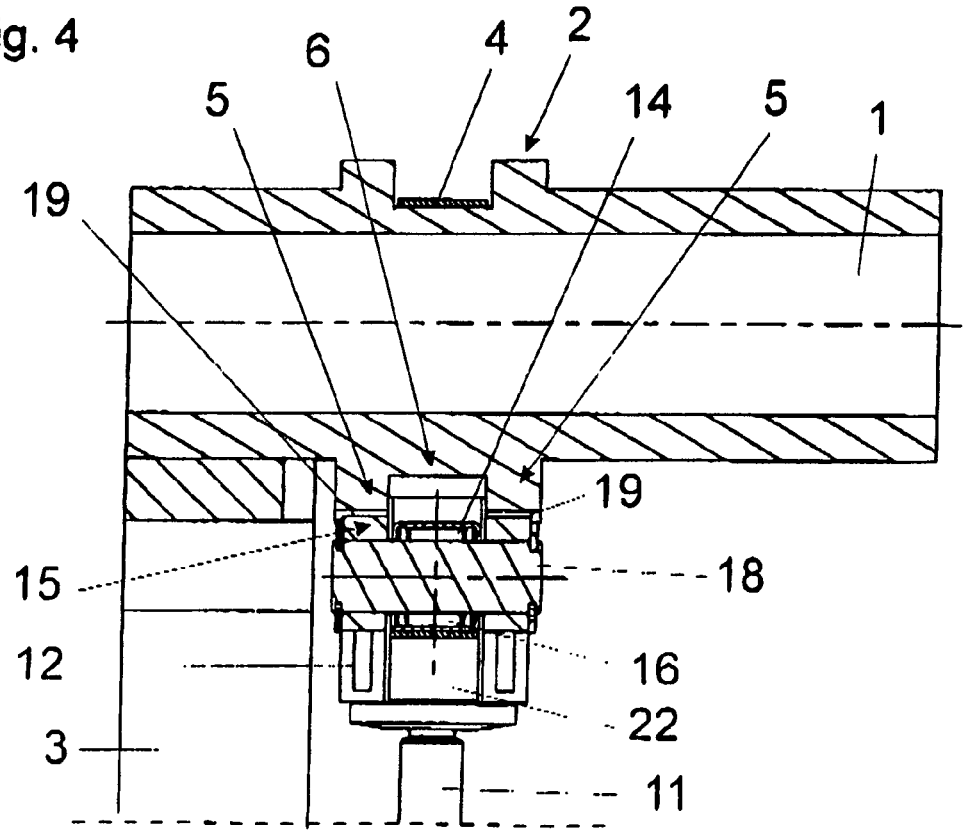
FIG. 4 shows a section along the line IV-IV from FIG. 3.

FIGS. 3 and 4 show a very similar embodiment, which differs essentially in that the return element 13 has a roller 14 which is mounted on the bolt 18 by means of a roller bearing 16 such that it can rotate and around which the flexible element 4, which is once again in the form of a closed loop, is guided. During the rotation of the cam element 2, the flexible element 4 will thus move over the roller 14 and will drive it, since considerably more friction occurs owing to the larger contact surface (which is preferably not subsequently machined) of the second cam area 6 between the flexible element 4 and the second cam area 6. If required, it is thus even possible to form an interlock between the second cam area 6 and the flexible element 4.

Figure 5:
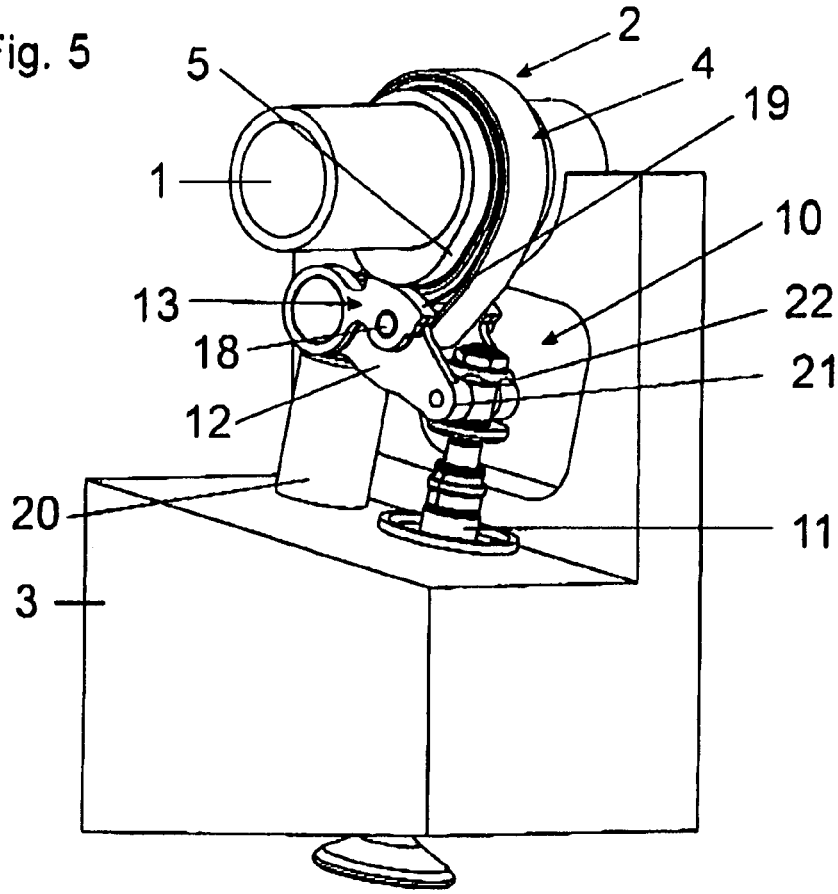
FIGS. 5 to 7 show a third embodiment with two first cam areas and one second cam area, with FIG. 5 showing an oblique view, FIG. 6 a cross section through the second cam area, and FIG. 7 a detail along the line VII-VII from FIG. 6.
Figure 6:
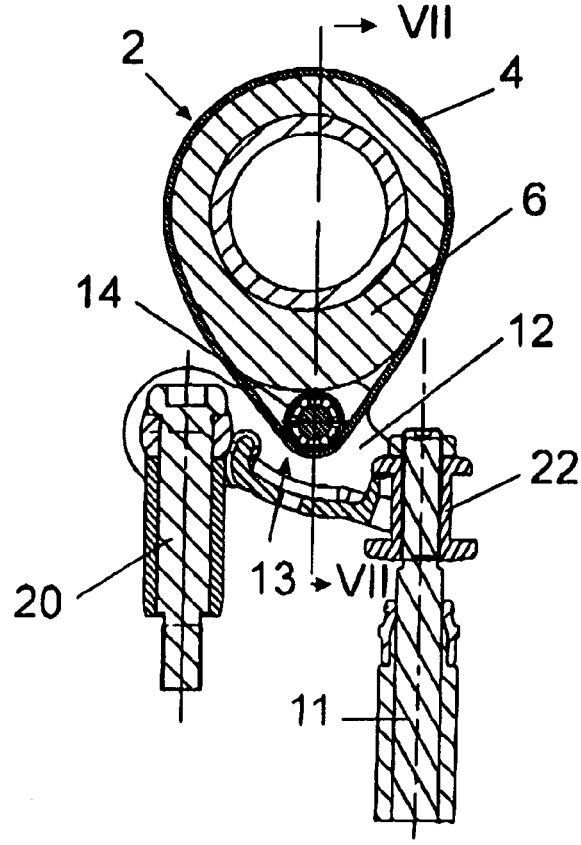
Figure 7:
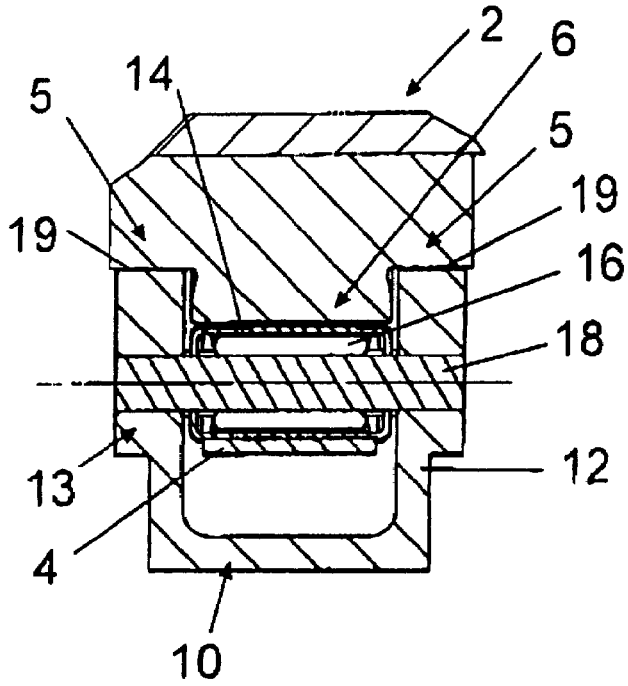

FIGS. 5 to 7 show an embodiment wherein the cam contour in the second cam area 6 is larger than the cam contour of the two first cam areas 5. The flexible element 4, which is once again in the form of a closed loop, is also guided in this embodiment via a roller 14, which is mounted in the drag lever 12 on the bolt 18 such that it can rotate. The larger contour of the second cam area 6 in its own right reduces the length error of the closed loop, and its derivation from the valve travel curve allows it to virtually disappear. The cam follower element 15 of the drag lever 12 is once again provided with two convex contact sliding surfaces 19 for making contact with the two first cam areas 5. The cam travel of the first cam area 5 is approximately 5 mm. Since the cam follower element 15 is arranged approximately centrally on the drag lever 12, the valve travel is approximately 10 mm. The first cam area 5 has a basic circle radius of about 17 to 18 mm, and a concave transitional area with a radius of between 40 and 70 mm is formed at the transition from the basic circle to the cam area 5, on the opening side. The radius of the curved contact sliding surface 19 of the cam follower element 15 is about 25 to 30 mm. A trial with this embodiment has shown opening accelerations of up to 150 mm/rad$^2$.

Figure 8:
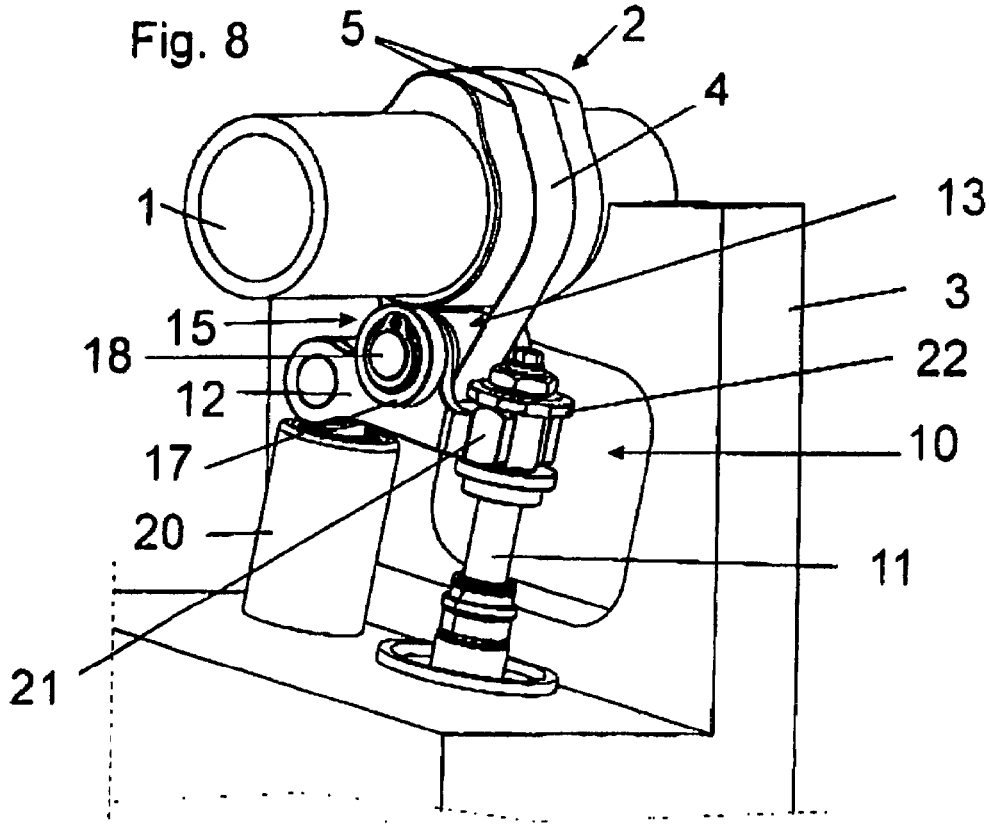
FIGS. 8 to 10 show a fourth embodiment with two first cam areas and one second cam area, with FIG. 8 showing an oblique view, FIG. 9 a section along the line IX-IX from FIG. 10 through the first cam area, and FIG. 10 showing a section along the line X-X from FIG. 9.
Figure 9:
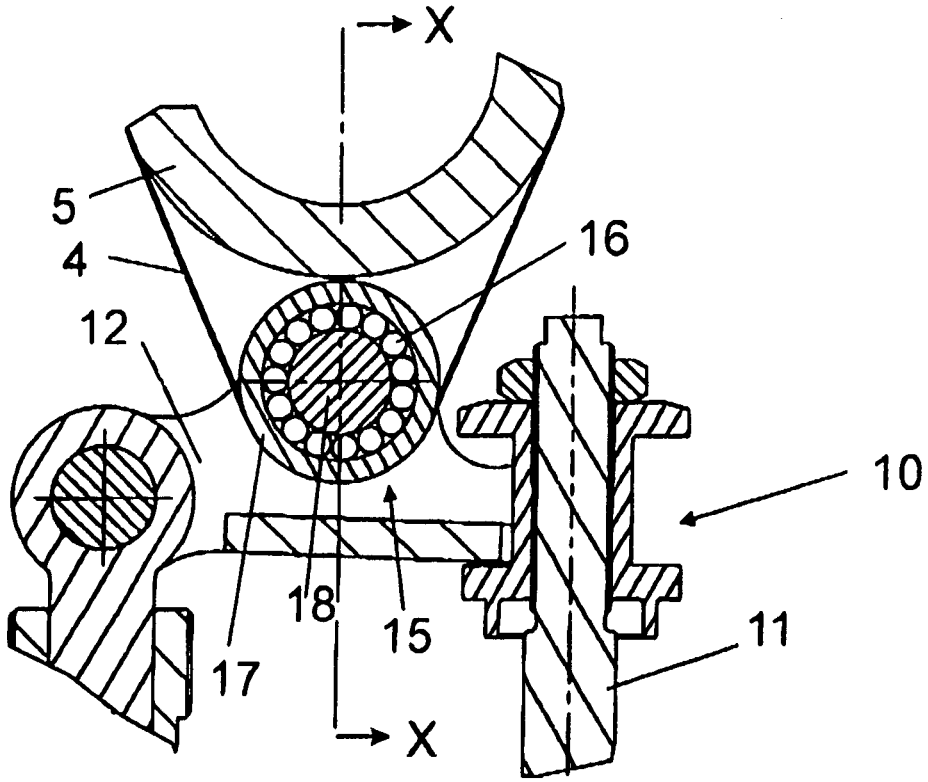
Figure 10:
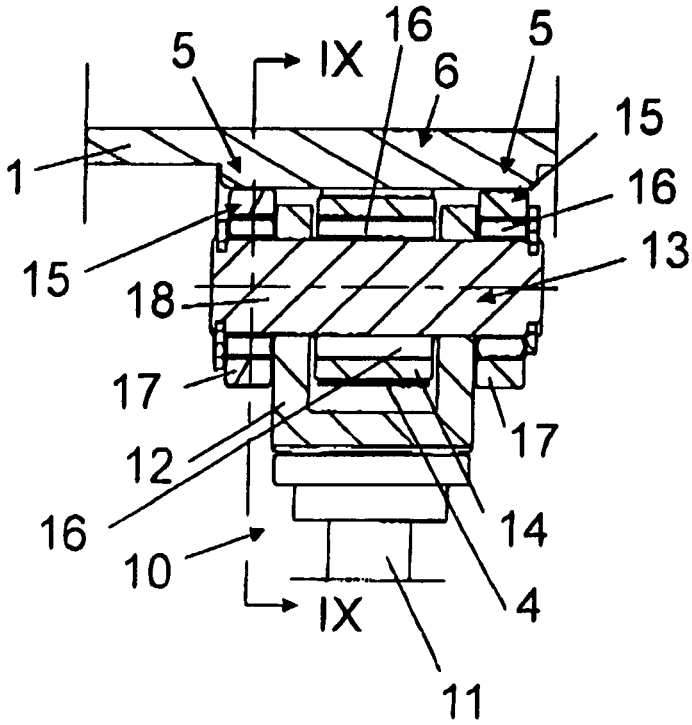

Instead of the contact sliding surfaces 19 of the cam follower element 15, it is also possible to provide rollers 17 mounted on the roller bearings 16 in this case. An embodiment such as this is shown in FIGS. 8 to 10, wherein the roller 14 (which is surrounded by the closed loop) of the return element 13 and the two rollers 17 of the cam follower element 15 are jointly mounted on the bolt 18, as can be seen in particular from FIG. 10. The axes of the rollers 14 and 17 may, however, also be arranged parallel to one another if this results in design and/or installation advantages, since parallel roller axes mean different lever ratios which, of course, have an influence on the contours of the two cam areas 5, 6. The embodiment in FIGS. 8 to 10 shows that the first and second cam areas 5, 6 are the same, and that the cam element 2 thus has no surface steps. The reduction in the length error of the flexible element 4 can be achieved despite the same cam contour and the common roller axis, by means of a smaller diameter of the roller 14.

Figure 2:
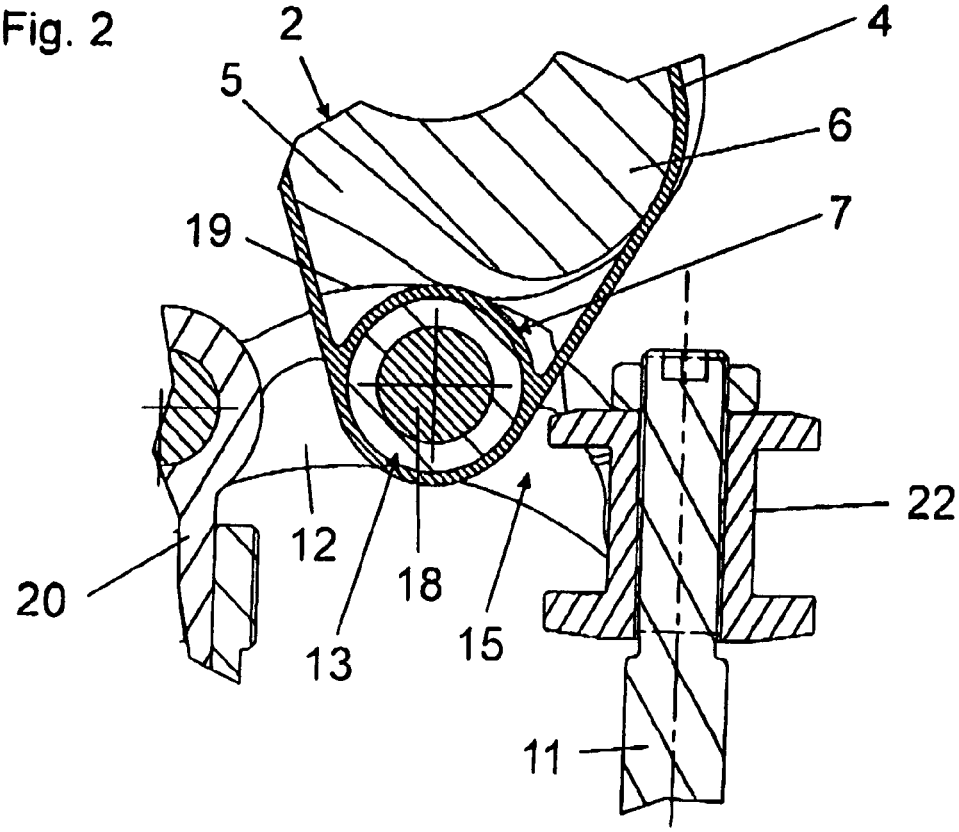

Trials and calculations have shown that length errors to be compensated for are in the order of magnitude of 0.1% to 0.5% of the valve travel, that is to say they are very small. These minor length errors of the flexible element 4 may be compensated for, for example, by materials with a limited expansion capability. For example, the flexible element 4 may be manufactured from a fabric strip which allows slight elastic length changes, so that the closed loop can be widened by the required amount. The expansion limiting can be achieved by fibers of constant length in the circumferential direction. In the embodiment shown in FIGS. 1 and 2, the length error could also be compensated for by a return element 13 composed of an elastically compressible material, for example by means of a rubber or plastic sleeve arranged on the bolt 18. In the embodiment shown in FIGS. 3 to 10, the length error can also be compensated for by an elastically compressible lining on the coating on the cam element 2 in the second cam area 6. This coating could, for example, be formed by a rubber strip or the like. A limited expansion capability of the flexible element 4 also makes it possible to install this prestressed, and to pull on it for play compensation and/or the production of a closing force.

Figure 11:
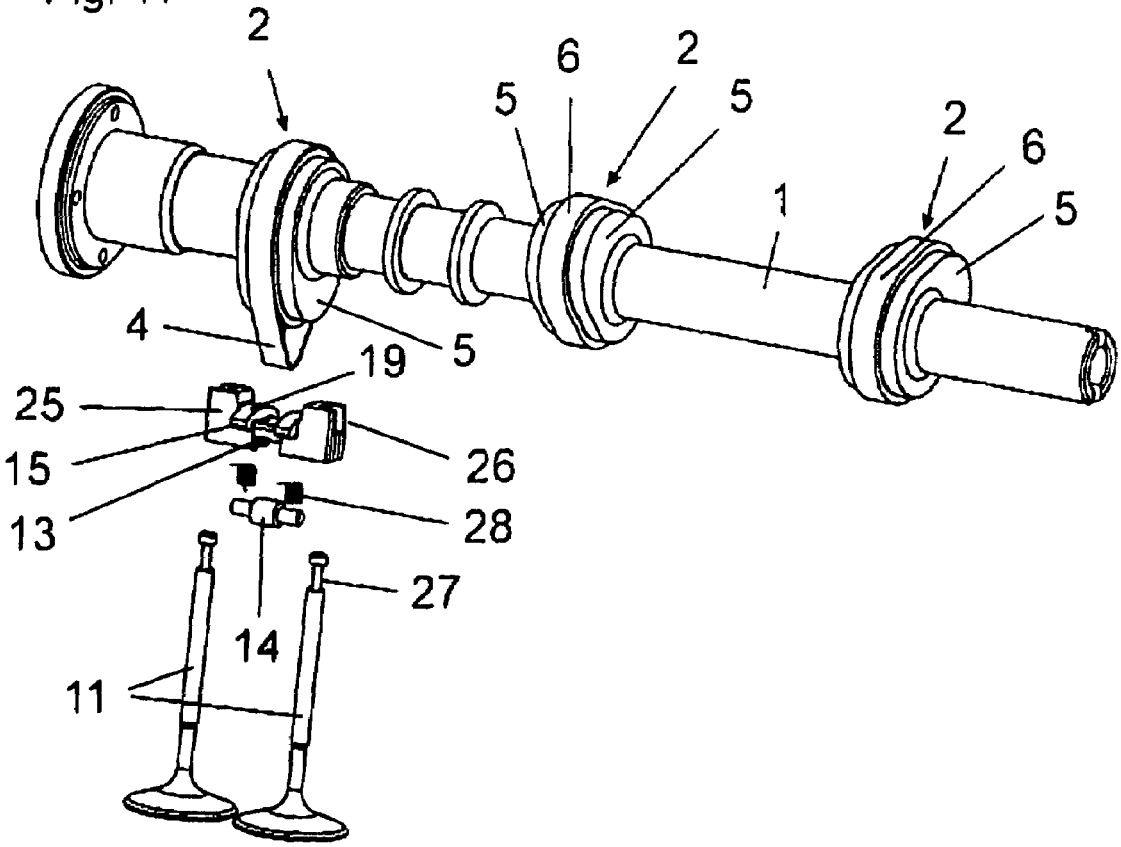
FIGS. 11 and 12 show a fifth embodiment with two first cam areas and one second cam area, with FIG. 11 showing an exploded illustration of a camshaft and of a valve drive for two valves, and FIG. 12 showing a section on the axial plane of the camshaft.
Figure 12:
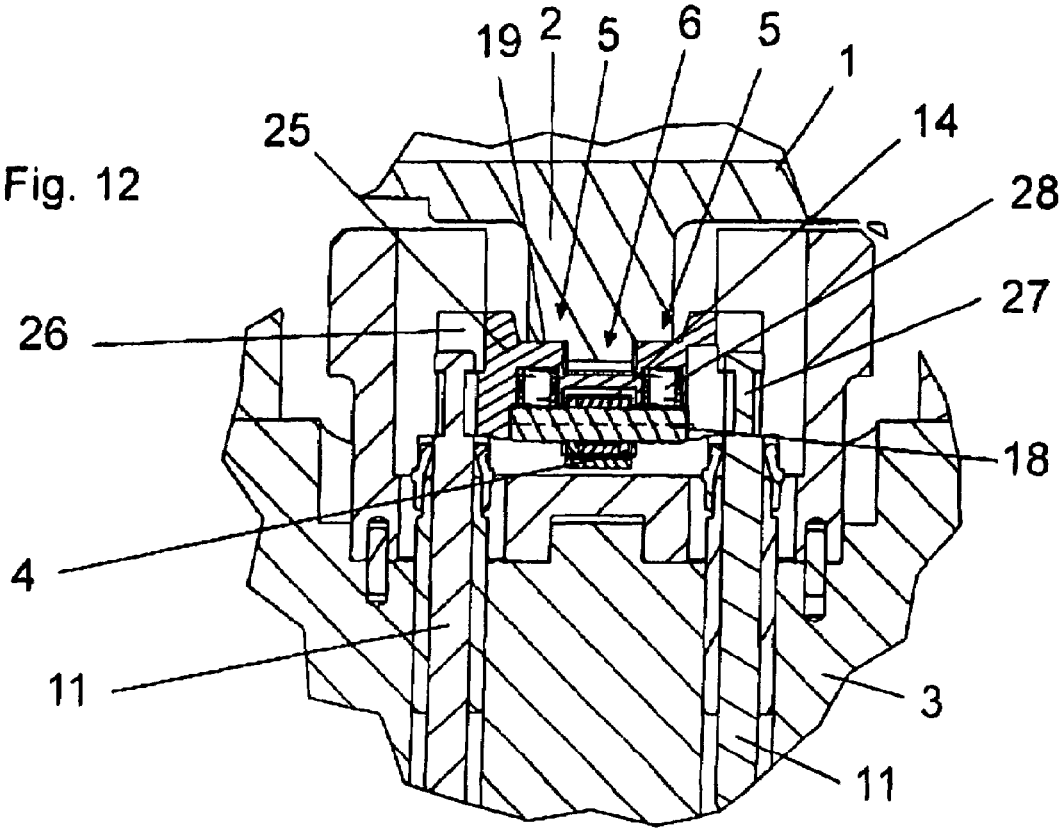
Figure 13:
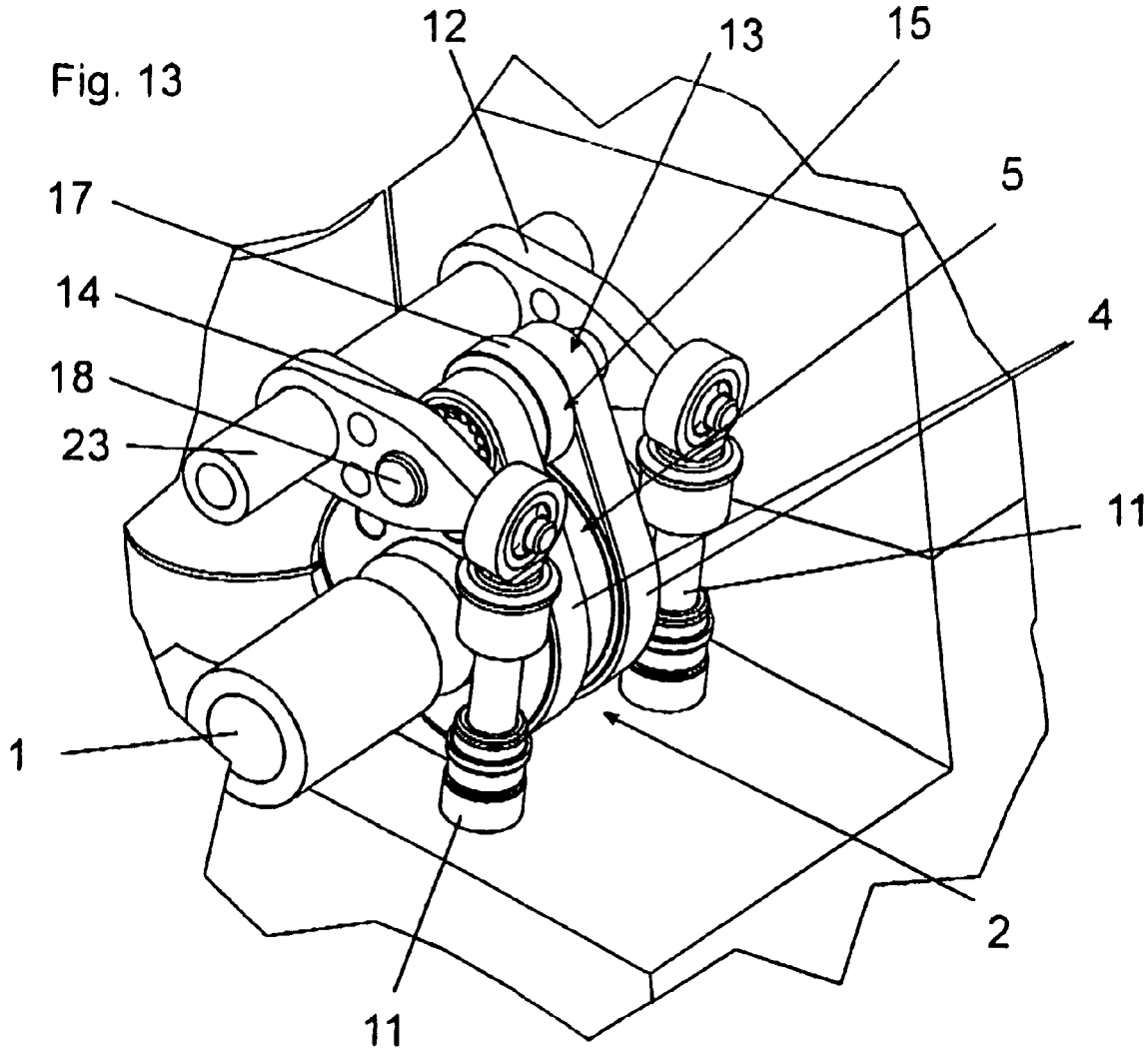
FIGS. 13 to 16 show a sixth embodiment with one first cam area and two second cam areas, with FIG. 13 showing an oblique view, FIG. 14 showing a plan view, FIG. 15 showing a section along the line XV-XV, and FIG. 16 showing a section along the line XVI-XVI in FIG. 14.
Figure 14:
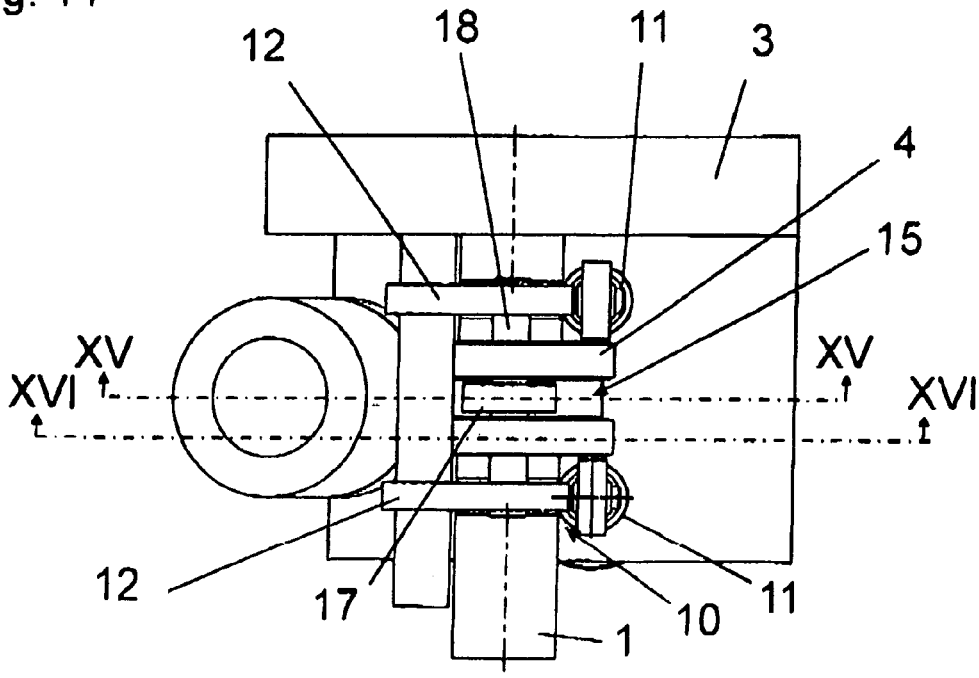
Figure 15:
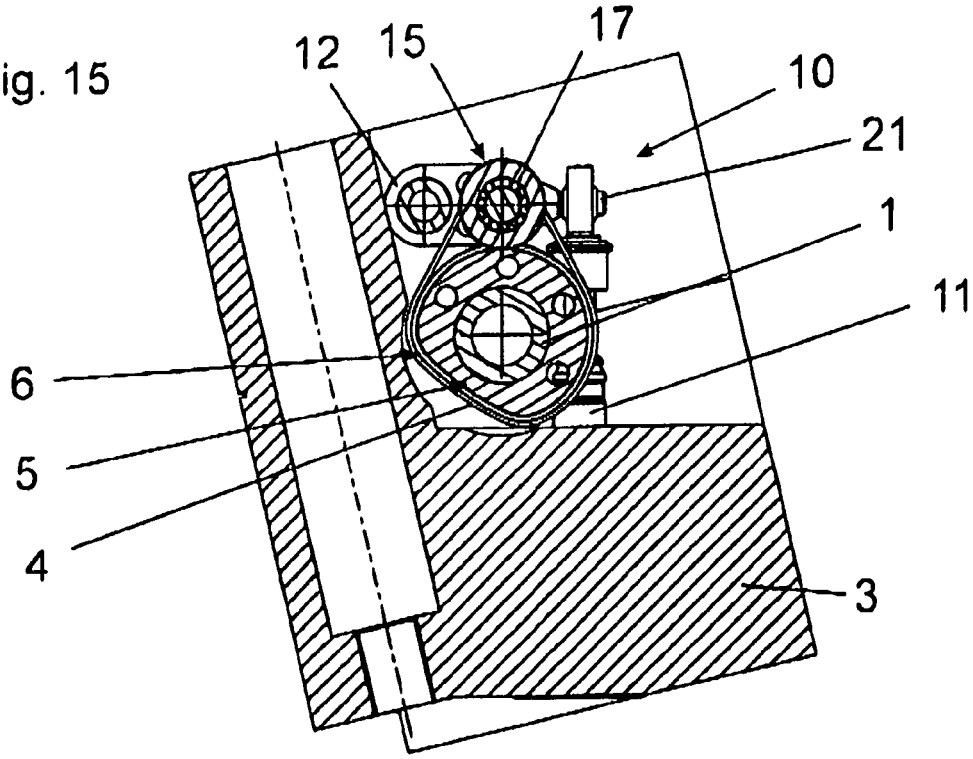

The embodiment shown in FIGS. 11 and 12 provides a further compensation capability, wherein the flexible element 4 (which is shaped to form a closed loop) has an associated holder 25 for two valves 12 which are arranged alongside one another and can be operated identically. The holder 25 has a roller 14 as the return element 13 in the central part, via which the flexible element 4 is guided, and its shaft bolts 18 are mounted in an elastically flexible form via two compression springs 28 in recesses in the holder 25, such that they can flex elastically in the movement direction of the valve 11. Instead of the two compression springs 28, it would also be possible to provide two apparatuses for hydraulic play compensation. The valves 11 have undercut heads 27, which are hooked into corresponding receptacles 26 in the holder 25. A cam follower element 15 with a convex contact sliding surface 19 is provided for each first cam area 5 on the holder 25. Since the valves 11 are arranged axially alongside the cam element 2, this allows a very small physical height and allows the valves 11 to be guided such that they come very close to the mounting shaft 1, as can be seen from FIG. 12. This embodiment requires little assembly effort and comprises a very small number of components. The contour of the second cam area 6, as is shown in FIGS. 5 to 7, is larger than the contour of the adjacent first cam areas 5 on both sides, so that there are no difficulties in manufacturing a cam element 2 such as this, either. The circumferential surface of the cam element 2 in the central second cam area 6 requires no subsequent machining nor extreme accuracy, since the flexible element 4 also rotates and there is no need to touch the cam contour. The cam element 2 can thus be mounted on the mounting shaft 1, for example, owing to the screw 29 or the like, as well (FIG. 11), which is provided in the basic circle section of the second cam area 6. Alternatively, other production methods are also possible for the cam areas or for the entire camshaft, for example by means of a sintering method, by diecasting, etc.

Figure 16:
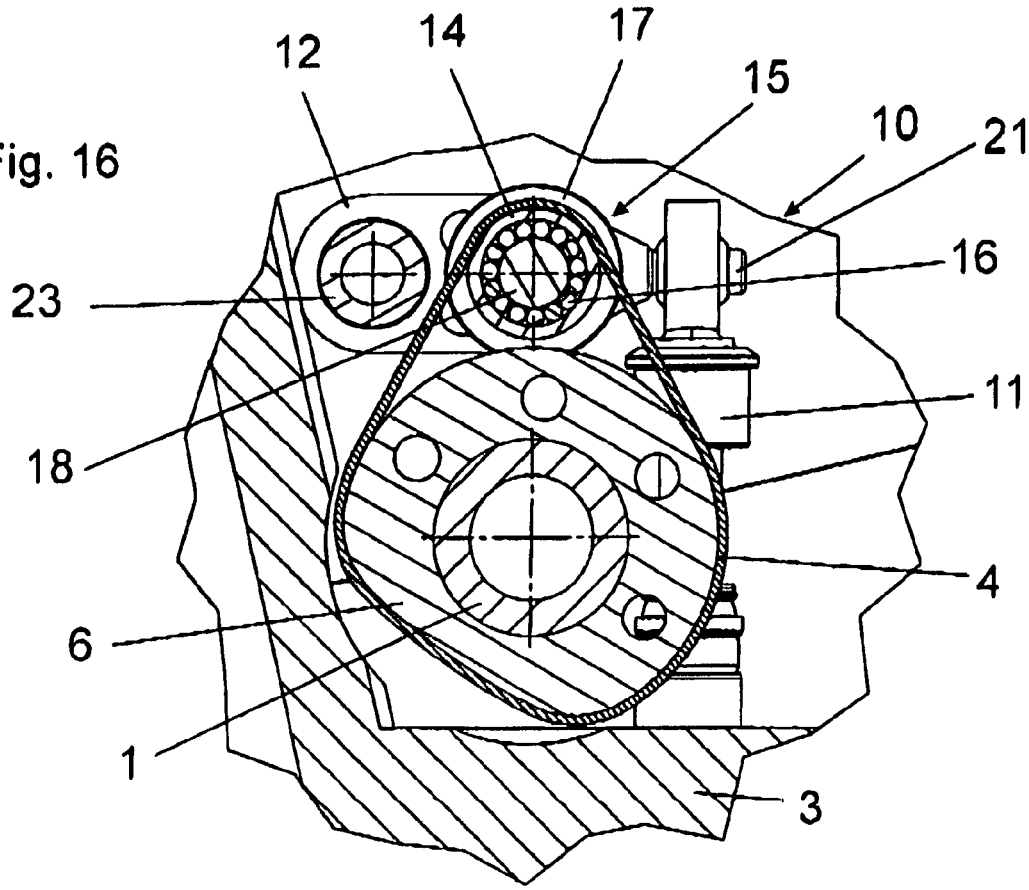

FIGS. 13 to 16 show an embodiment wherein the two second cam areas 6 enclose a first cam area 5 between them. The embodiment thus also contains two flexible elements 4 and only one cam follower element 15 with a roller 17 which is mounted such that it can rotate. The two flexible elements 4 are each guided around a roller 14 of the return element 13, with the three rollers 14, 17, 14 once again being provided on a common shaft bolt 18. The ends of the bolt 18 are fixed in two drag levers 12, which are mounted such that they can rotate on a shaft 23 which extends parallel to the mounting shaft 1, and extend above the mounting shaft 1 to two common valves 11, which can be operated jointly. The heads of the valves 11 have spherical holes, wherein the rounded ends 21 of the drag levers 12 engage. The drag levers 12, which cover the mounting shaft 1, require a cam element 2, whose contour is recessed with respect to the basic circle section in both cam areas 5, 6—cam shapes such as these are also referred to as negative cams. The illustration shows the closed position of the valves 11, wherein the roller 17 of the cam element 15 (as can be seen in particular from FIG. 15) rolls on the basic circle section until it reaches the recessed first cam area 5. The roller 17 approaches the rotation axis of the mounting shaft 1 and pushes the valves 11 downwards, so that they are opened. The identical negative contour on the second cam area 6, as can be seen in FIG. 16, allows this opening movement of the valves 11 since the roller 14 is also pulled closer to the rotation axis, because the circumferential length of the complete basic circle section is larger than the circumferential length of a basic circle section wherein the cord-like recess in the cam area is contained. During further rotation, the roller 17 is pushed away from the rotation axis of the mounting shaft 1 upwards again and the valves are closed, with the closed loop of the flexible element 4 allowing the necessary lengthening, since the lower circumferential length is once again shorter, as can also be seen from FIG. 16.

Those sections of the flexible element 4 which extend linearly between the second cam area 6 and the return element 13 can be curved inwards by means of at least one further roller arranged on the outside, so that the force introduction is improved, and the tensile force load on the flexible element 4 is reduced. This further roller may also be designed to be elastically flexible or may be mounted in the form of a belt tensioning device, and can thus likewise contribute to compensation for the length error.

Figure 17:
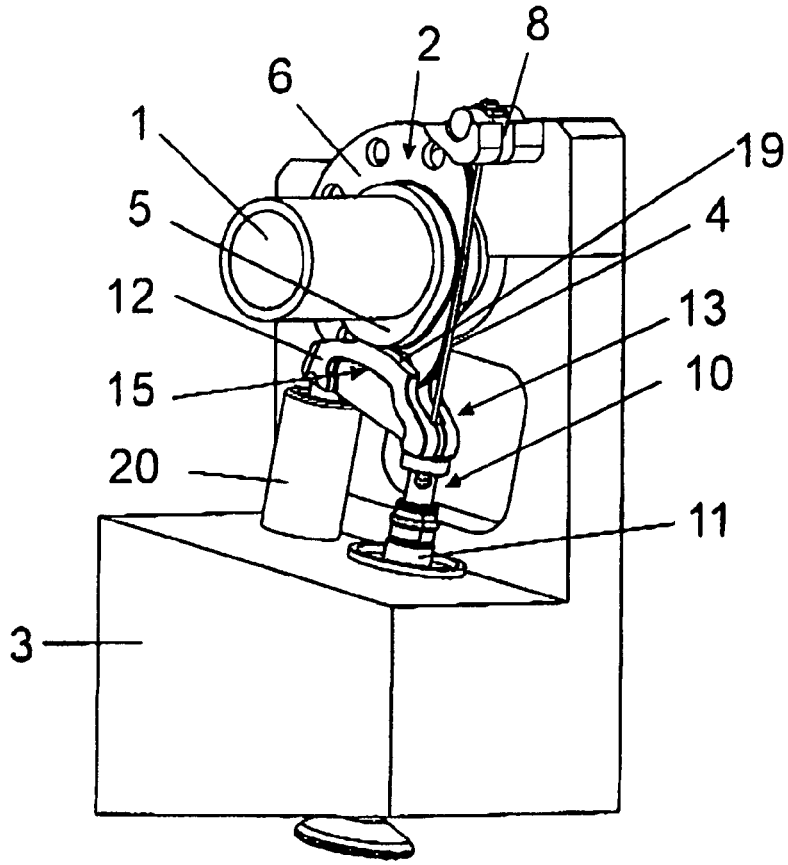
FIGS. 17 to 22 show a seventh embodiment with two first cam areas and one second cam area, with FIG. 17 showing an oblique view with the valve open, FIG. 18 showing an oblique view with the valve closed, FIG. 19 showing a cross section through the first cam area with the valve open, FIG. 20 showing a cross section through the first cam area with the valve closed, FIG. 21 showing a section along the line XXI-XXI in FIG. 19, and FIG. 22 showing a section along the line XXII-XXII from FIG. 20.
Figure 18:
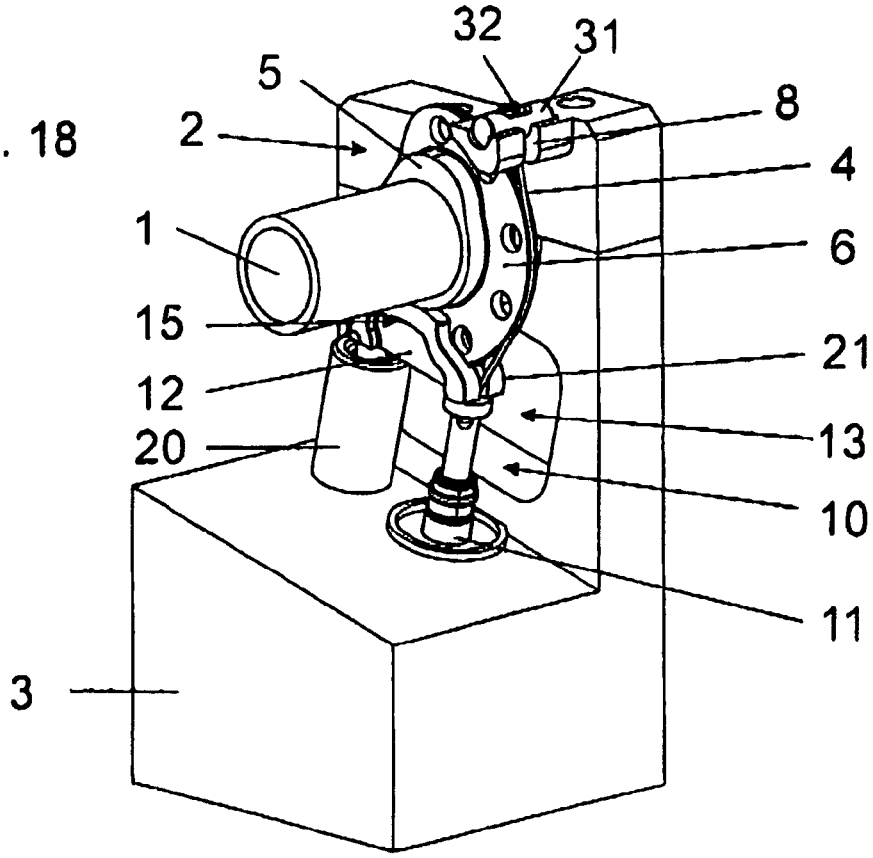
Figure 19:
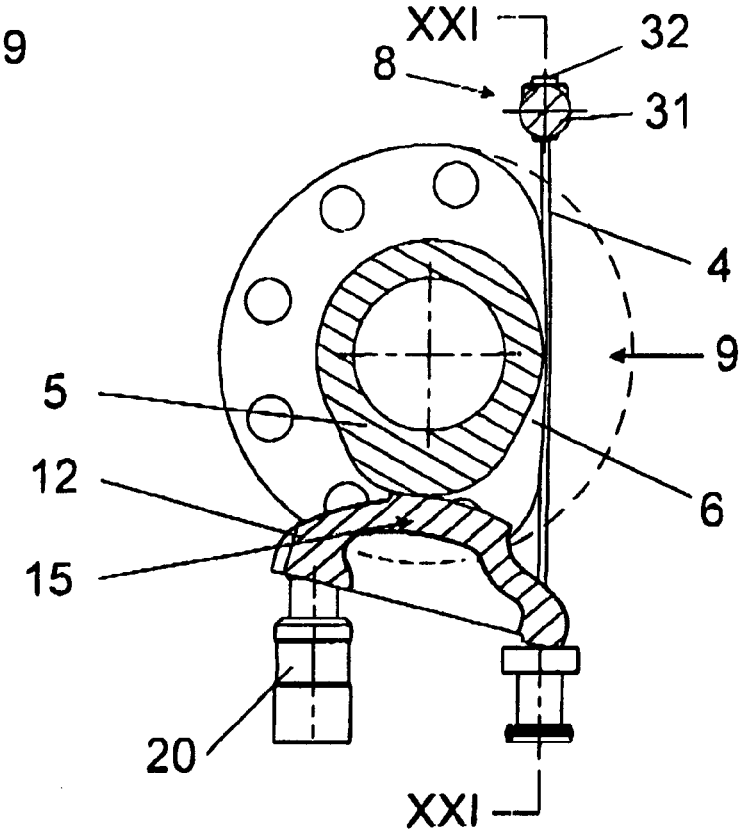
Figure 20:
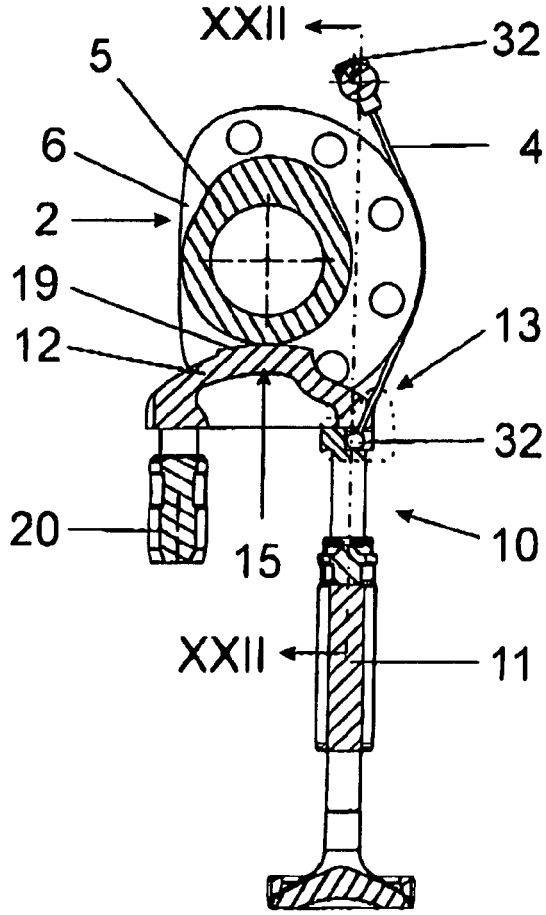
Figure 21:
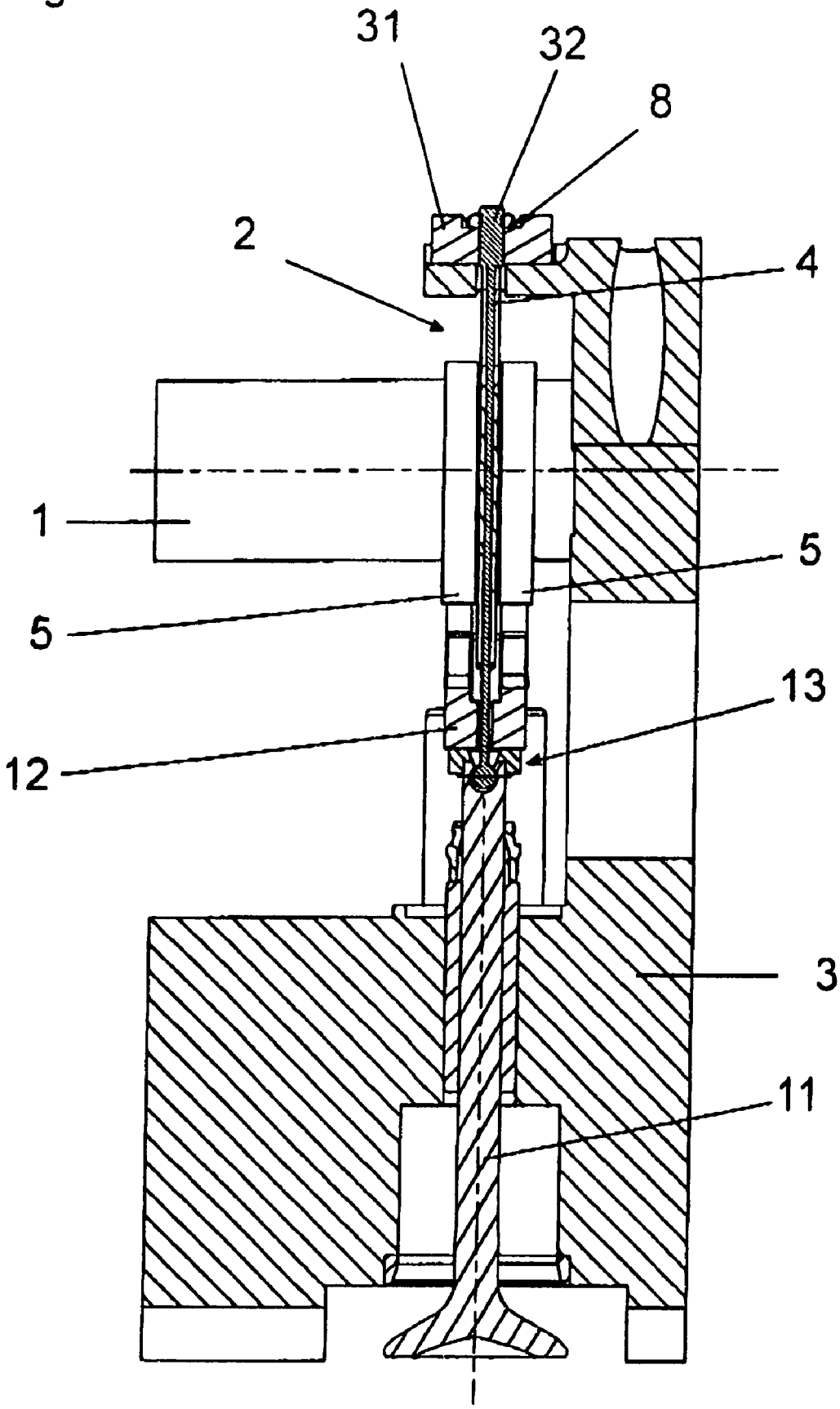
Figure 22:
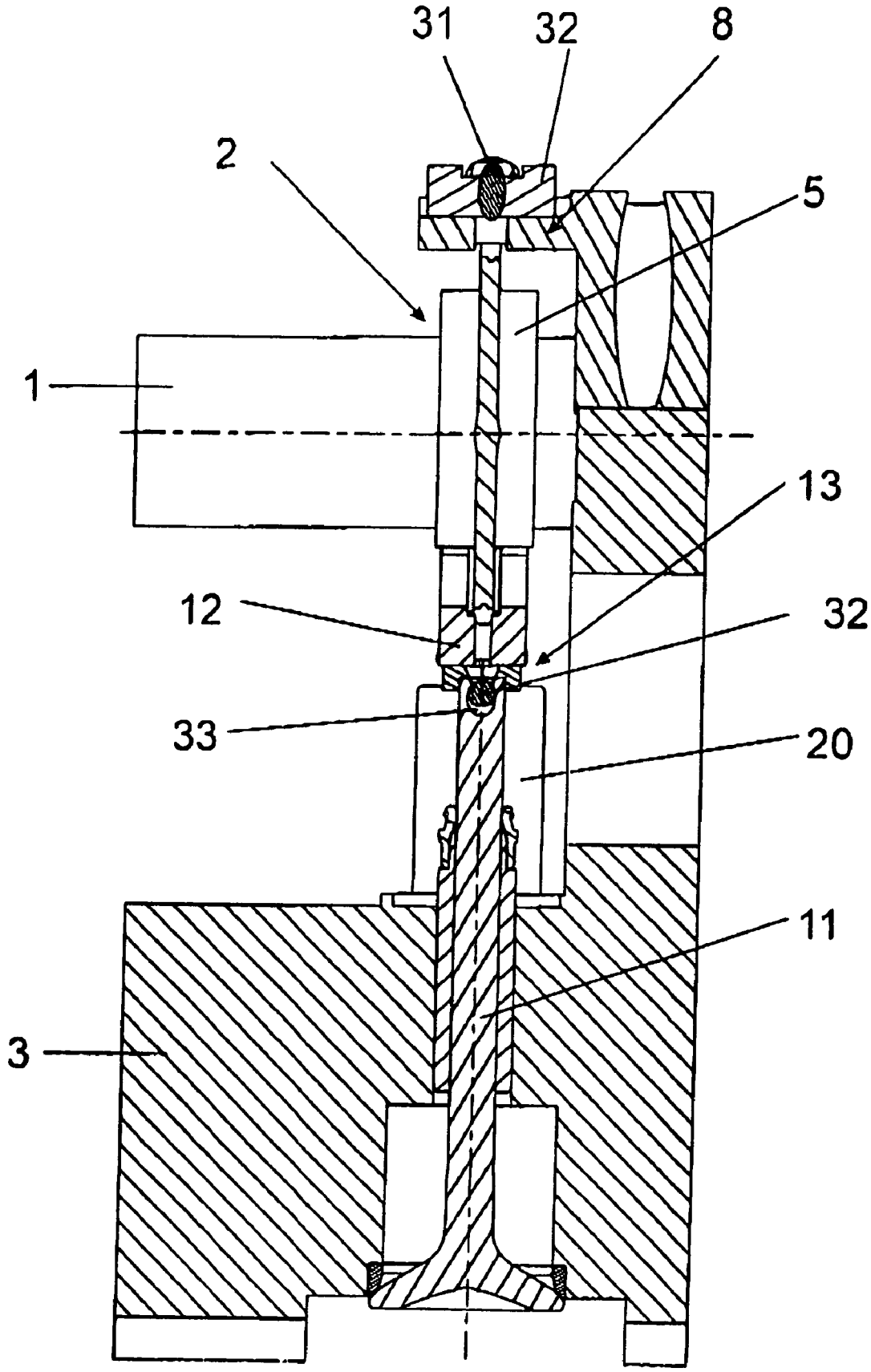

FIGS. 17 to 22 show a first exemplary embodiment, wherein the flexible element 4 is not an intrinsically closed loop, but has a finite length. This embodiment once again has two first cam areas 5, between which the second cam area 6 is arranged. The first cam areas 5 are raised and interact with the cam follower element 15 (which has two contact surfaces 19) of the drag lever 12, which is mounted such that it can pivot in an adjustable bearing 20 in the cylinder head 3. To this extent, this embodiment corresponds to the already described embodiments shown in FIGS. 1 to 7, 11 and 12. The second cam area 6 is recessed and represents a negative cam, whose maximum is located closer to the rotation axis of the cam element 2 than its basic circle section, and is also rotated with respect to the first cam areas 5. FIGS. 17, 19 and 21 show the valve 11 in the open position. FIG. 19 in particular shows that a space which is referred to as a revolution space 9 remains between the recessed, second cam area 6 and the complete circle, which is shown by dashed lines, and this space is filled by the basic circle section of the second cam area 6 in the closed position as shown in FIG. 20. The flexible element 4, which has a finite length, is fixed at one end to the return element 13 of the reciprocating part 10, that is to say either to the drag lever 12 or to its free end 21, or to the head of the valve 11, and at the other end to the upper attachment point 8 of the cylinder head 3, which is chosen to be sufficiently close to the bearing of the mounting shaft 1 that the flexible element 4 fits, in its linear, longest extent, the recessed second cam area 6, in the form of a tangent.

As can be seen from FIGS. 19 to 21, the flexible element 4 is in the form of a cable, and the circumferential surface of the cam element 2 is provided in the second cam area 6 with a groove wherein the cable is guided laterally. The cable preferably extends essentially on the same axis as the valve 11, and is provided at both ends with a thickened area 32, in the same way as the cable of a Bowden cable, which thickened area 32 is hooked into a roller 31, which is mounted at the attachment point 8 such that it can rotate, and, at the valve 11, is hooked into an undercut receptacle 33, which is used as a return element 13. As is in each case evident from a comparison of FIGS. 17 and 18, 19 and 20, 21 and 22, the flexible element 4 has its greatest length when the valve 11 is in the open position, wherein the first and second cam areas 5, 6 are being used. During rotation of the cam element, the flexible element 4 bulges outwards at the sides as a result of the basic circle section of the second cam area 6 and its effective length is shortened, so that the valve 11 which is attached to it is pulled up to the closed position. The formation of the return element 13 on the valve 11 itself means that there is no need for the valve 11 to be driven to the closed position by the drag lever 12, whose free end 21 just has to rest on the upper face of the valve 11, in order to open it. The radius of the basic circle section of the second cam area 6 governs the valve travel, that is to say the linear movement of the valve 11, with the valve travel representing the difference between the arc length and the cord length of the basic circle. The cam element 2 thus has a considerably larger diameter in the second cam area 6 than in the first cam area 5, in order to match normal lengths of the valve travel. A space-saving solution is nonetheless obtained by the drag lever 12 having a free space between the two contact sliding surfaces 19, for the second cam area 6 to pass through.

Figure 23:
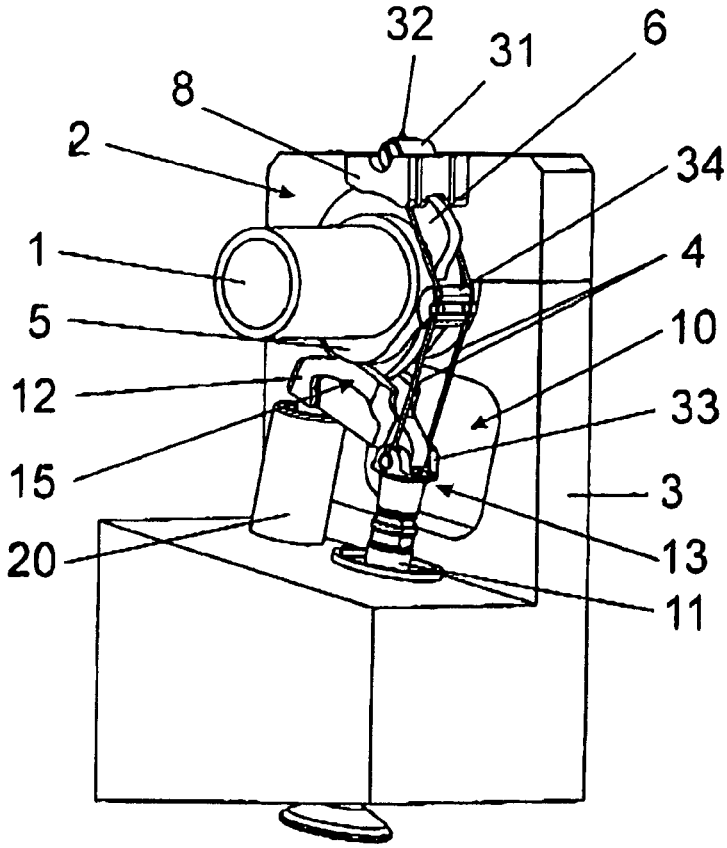
FIGS. 23 and 24 show an eighth embodiment with two first cam areas and one second cam area, with FIG. 23 showing an oblique view and FIG. 24 showing a cross section through the first cam area.
Figure 24:
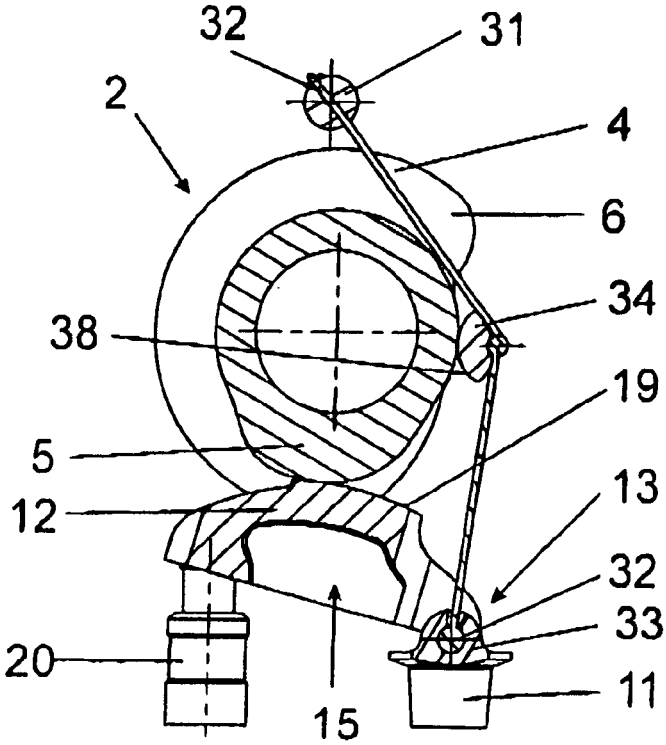

FIGS. 23 and 24 show a similar embodiment with two flexible elements 4, which are connected to the upper attachment point 8 and to a receptacle 33 which is formed at the head of the valve 11, with the two flexible elements 4 extending on both sides of the second cam area 6. The two flexible elements are connected approximately centrally by means of a transverse element 34, which rests on the second cam area 6, which once again has a negative cam contour. The transverse element 34 is provided with a convex contact sliding surface 38, thus resulting in only a linear contact between the transverse element 34 and the second cam area 6 in all positions. The transverse element 34 may also be provided with a roller, which rolls on the second cam area 6. The first cam areas 5 and their contact with the cam follower element 15, which is provided on the drag lever 12, correspond to the embodiment shown in FIGS. 17 to 22. In this embodiment as well, cables which are thickened at the ends, in particular, are hooked into corresponding upper and lower holders as the flexible elements 4. Instead of two flexible elements 4, it is also possible to use a single element, whose two ends are hooked either into the upper holder 8 or into the lower holder 33, with the central area of this single element having its direction changed in the respective other holder 33, 8.

Figure 25:
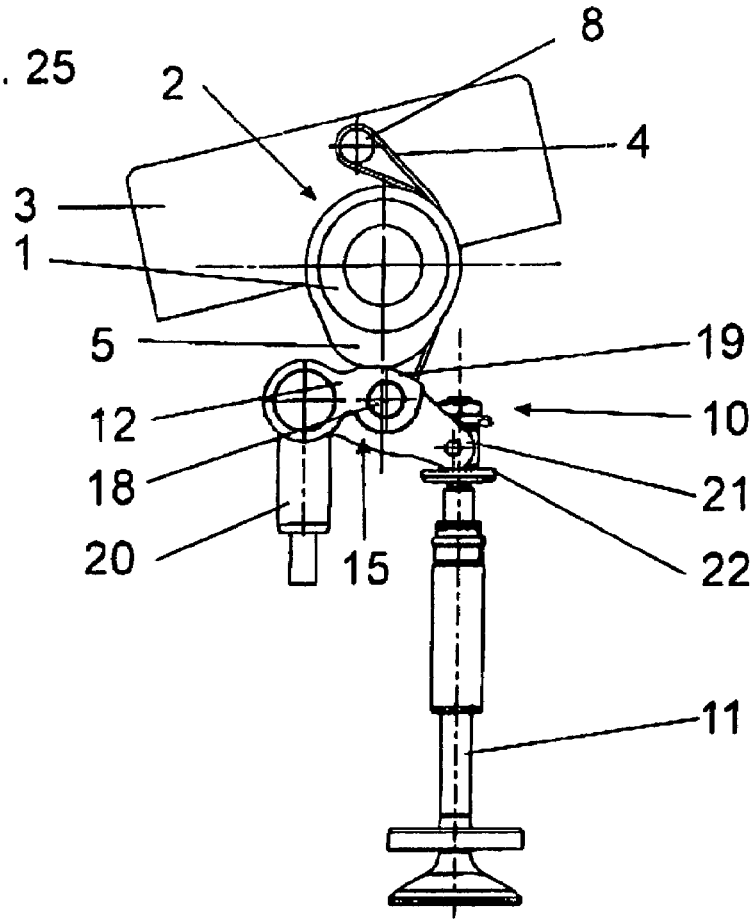
FIGS. 25 and 26 show a ninth embodiment with two first cam areas and one second cam area, with FIG. 25 showing an end face view and FIG. 26 showing a cross section through the second cam area.
Figure 26:
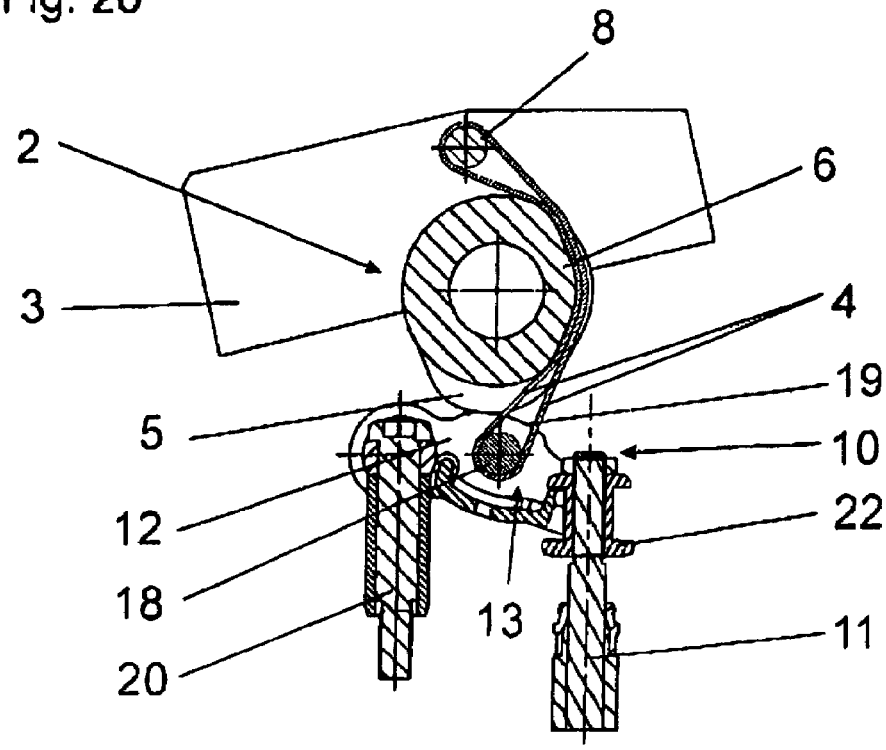

FIGS. 25 and 26 show an embodiment which once again requires raised and recessed cam areas 5, 6 because the attachment point 8 is fixed to the cylinder head, with the negative cam area 6 being arranged between the two positive cam areas 5. The upper attachment point 8 is in the form of a rod or bolt which extends parallel to the mounting shaft 1, and a bolt 18 is fixed between two webs on the drag lever 12 on the reciprocating part 10, in a similar manner to the embodiment shown in FIGS. 1 to 10. The flexible element 4 is in the form of a closed loop and is guided via the rod of the attachment point 8 and the bolt 18, with both sections of the flexible element 4 moving passed the same face of the cam element 2. A roller can be provided on both the upper and lower guide.

The embodiments so far have made use of flexible elements 4 which, by way of example, are formed by a strip or a ribbon composed of a flat material, wherein threads or fibers are provided in a textile bond and which is produced without any seams using a textile circular working technique (circular weaving, circular stitching, circular knitting, tube sock knitting, etc.). A circular-woven closed loop preferably contains aramide, Kevlar®, carbon or glass fibers as warp threads running in the circumferential direction, whose length is highly constant and which are resistant to temperature. The flexible element 4 may also be a steel strip which, for example, is manufactured from a titanium alloy, or a cable composed of any desired material.

Figure 27:
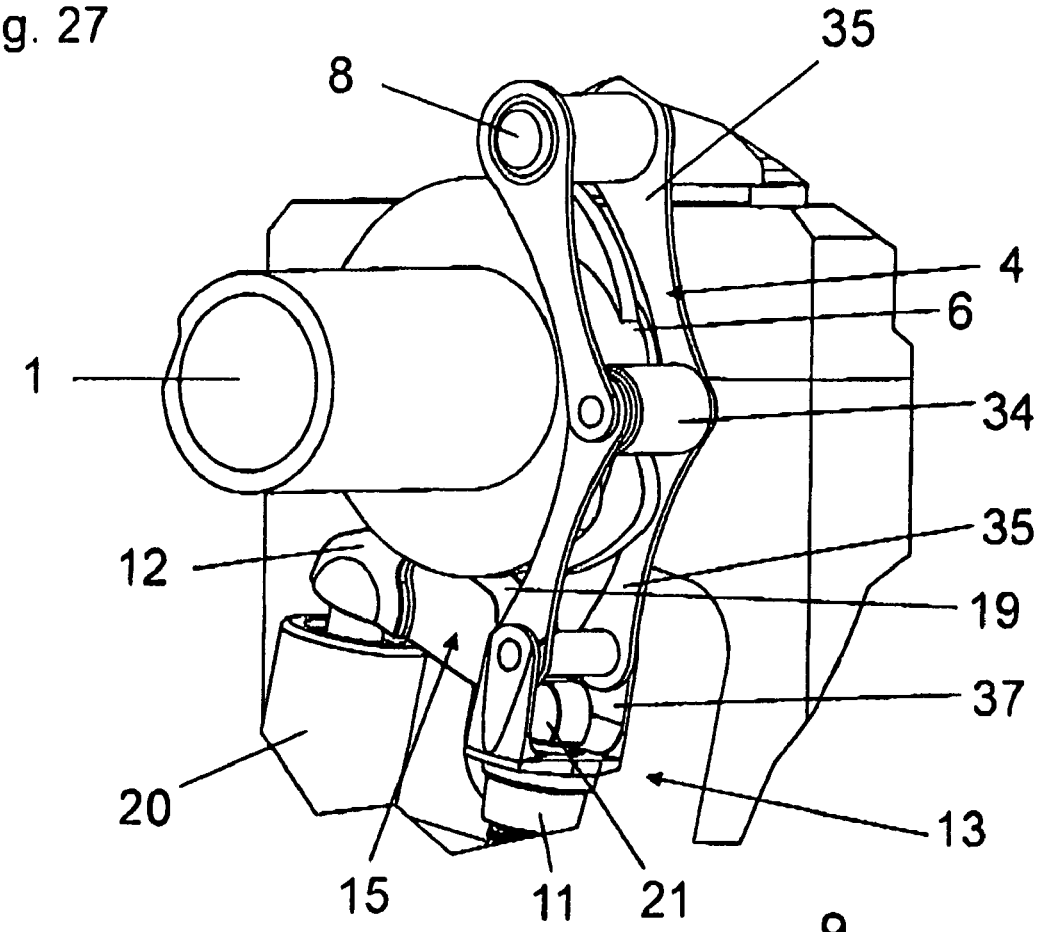
FIGS. 27 and 28 show a tenth embodiment with one first cam area and two second cam areas, with FIG. 27 showing an oblique view and FIG. 28 showing a cross section.
Figure 28:
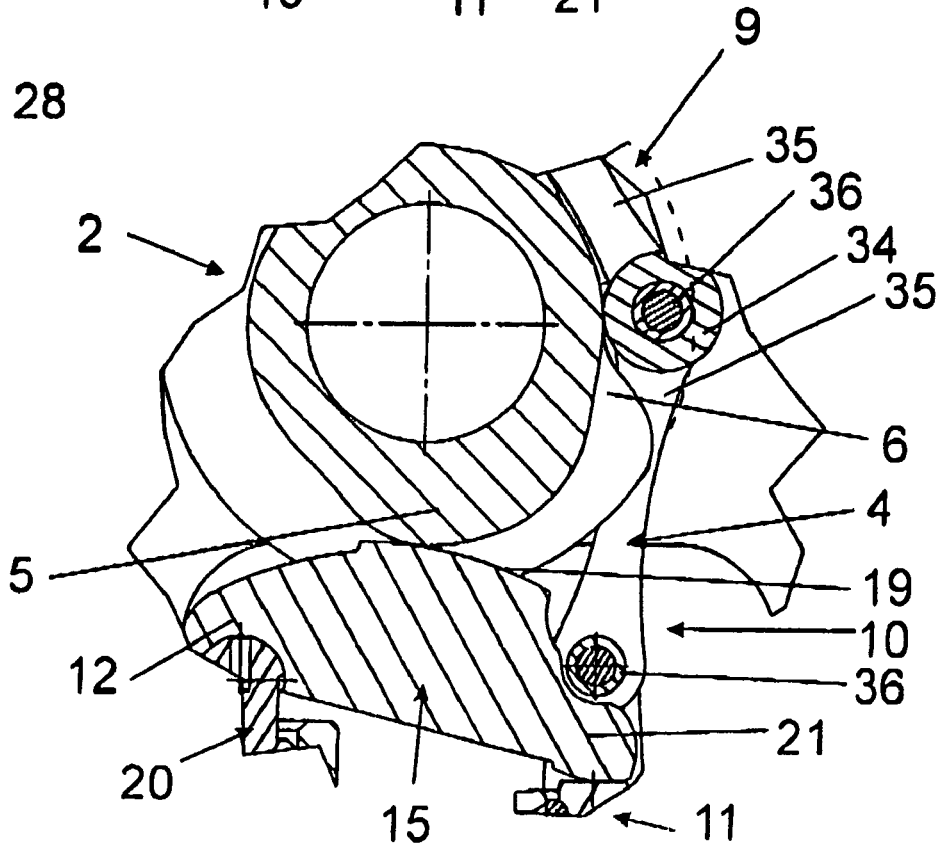

In the embodiment shown in FIGS. 27 and 28 which, in principle, corresponds to the embodiment shown in FIGS. 23 and 24, the flexible element 4 is formed by at least two links of a chain, which is arranged between the upper attachment point 8 (which is formed by a rod or bolt) and an approximately U-shaped holder 37 which is fitted to the head of the valve 11 and is used as the return element 13. The two chain links comprise side lugs 35 which are connected by a hinge pin 36 which acts as a cross section 34. A further hinge pin 36 acts as a hinge for the lower chain link on the holder 37. In this embodiment, the cam element 2 has two second negative cam areas 6 and a central first, positive cam area 5. The flexible element 4 once again passes through the revolution space 9 of the second cam areas 6, so that the flexible element 4 bulges out at the sides beyond the basic circle section, and the valve 11 is pulled up to the closed position. A roller which rests on the contour of the two second cam areas 6 is mounted on the hinge pin 36. The lugs 35 are located on both sides outside the cam element 2, and the cam follower element 15, which is provided on the drag lever 12, engages between the two second cam areas 6, so that this embodiment as well is physically very compact. The free end 21 of the drag lever 12 engages in the U-shaped holder 37 underneath the lowest hinge pin 36.

The drag lever holder 20 is fixed on the cylinder head 3 such that it can move, preferably parallel to the valve 11. If the fixing of the drag lever holder 20 (which is not shown) becomes loose, and the valve 11 is at the same time locked in the closed position then the rotation of the cam element 2 instead of the valve 11 results in the drag lever holder 20 moving with the drag lever 12. The cylinder associated with that valve is thus very easily disconnected.

The masses to be accelerated in a positive-guidance apparatus according to the invention are reduced by the lack of return spring elements and by the reciprocating part 10 having a considerably lighter weight design. The use of light alloys, ceramics or plastic for the valve allows a reduction in the masses to be accelerated and decelerated of 50% to 80% of the value of a valve tappet with a return spring and hydraulic play compensation. The high values result in particular in the partial load range, since the valve springs must be designed to be reliable on full load. Furthermore, the valve can be designed to be shorter, since there are no space-consuming valve springs.

The cam element can also be designed to be smaller. It is likewise also possible to use plastic cam elements and/or cam shafts produced completely from plastic, for example by injection molding. It is also possible to use other lightweight materials for the production of the camshafts or of the cam elements, for example aluminum. The reduction in mass and the sliding lubrication allow fuel savings of 5% or more to be expected.

Figure 29:
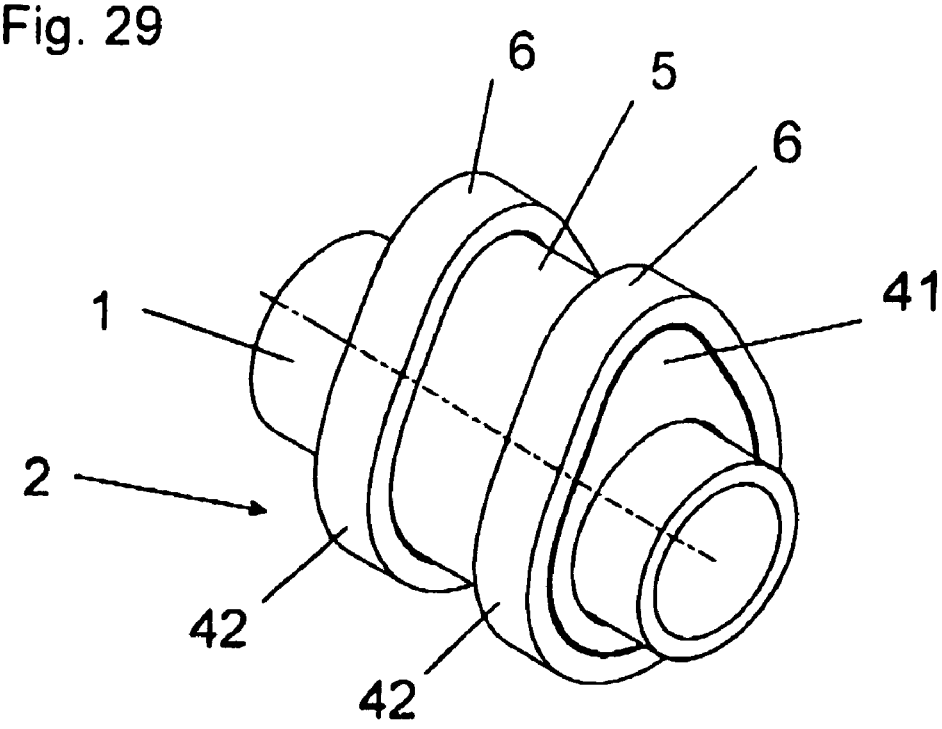
FIGS. 29 and 30 show an oblique view and a longitudinal section of one preferred embodiment of a cam element.
Figure 30:
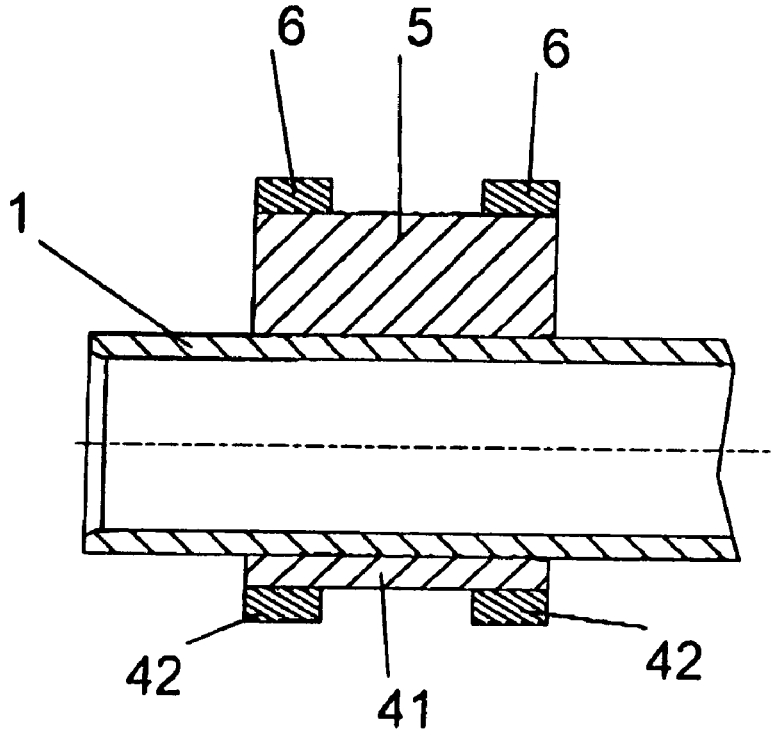

One preferred option for the production of a cam element 2 which has two different cam areas 5, 6 is shown in FIGS. 29 and 30. The cam element 2 is composed of a cam part 41, which is attached to the mounting shaft 1, and a cam part 42 which is mounted on the cam part 41. The cam part 41 of the cam element 2, which can be used in the embodiments shown in FIGS. 13 and 27, has the same contour as the first cam area 5, is composed of conventional cam material, and is subsequently machined and ground, in particular in the central section, wherein the first cam area 5 is formed. Each of the two second cam parts 42 is in the form of a sleeve or perforated disk, with the opening having the same contour as the first cam area 5, and the external contour corresponding to the contour of the second cam area 6. As is shown in FIG. 29, one second cam part 42 is arranged at each of the two ends of the first cam parts 41, with the non-circular opening producing an interlock on the non-circular first cam part 41 in the rotation direction, so that the two second cam parts 42 need be fixed only axially.

Cam elements 2 for the embodiments shown in FIGS. 5, 11, 17, 23 and 25 may be designed in a similar form, that is to say one second cam part 42 is arranged centrally on the first cam part 41, thus resulting in a first cam area 5 remaining free on both sides.

In the case of a cam element for the embodiments shown in FIGS. 1 and 3, the first cam part 41 is designed to have the same contour as the second cam area 6, and the two first cam areas 5 are provided on second cam areas 42 which are in the form of sleeves and are once again arranged at the ends. In this embodiment, in particular, the second cam parts 42, which require high precision, could be represented by sintered element arranged on the non-circular first cam part 41, which in general need no subsequent machining owing to the very high production accuracy. If the first cam parts 41 are not produced integrally with the mounting shaft, they can be attached in the second cam area 6 which is located in between and interacts with the flexible element 4.

This application claims the priority, under 35 U.S.C. § 119, of European patent application No. 04 018 342.8, filed Aug. 3, 2004 and European patent application No. 05 000 881.2, Jan. 18, 2005; the disclosures of the prior applications are herewith incorporated by reference in their entirety.

I claim:

1. A positive-guidance apparatus for conversion of a rotary movement of a drive to a reciprocating movement of a part, the apparatus comprising:

a first cam having formed thereon a first cam area disposed to directly push the part away from a given position resting against the first cam;

a flexible element having an end connected to the part; and a second cam having formed thereon a second cam area disposed to interact with said flexible element to pull the part back solely by way of said flexible element into the given position resting against the first cam; and wherein:

said first and second cam areas have mutually different contours;

a contour of said second cam area is outside of a contour of said first cam area;

said second cam area is formed on said second cam in the form of a sleeve and an internal contour corresponds to the contour of the first cam area; and said cam element has a first cam having a holding area formed thereon axially alongside said first cam area, having the same contour as the first cam area, and having said second cam with said second cam area disposed thereon.

2. The apparatus according to claim 1, wherein said first and second cam areas are offset with respect to one another.

3. The apparatus according to claim 2, wherein said second cam area is axially offset with respect to said first cam area.

4. The apparatus according to claim 1, wherein said first and second cams are disposed on a common mounting shaft.

5. The apparatus according to claim 1, wherein said first and second cams are disposed directly adjacent to one another on said common mounting shaft.

6. The apparatus according to claim 1 configured as a cam controller in a valve drive for an internal combustion engines for a motor vehicle, and wherein the part is a valve.

7. The apparatus according to claim 1, wherein said first and second cams are commonly formed on an integral cam element.

8. The apparatus according to claim 1, wherein said flexible element extends between an attachment point close to a bearing of said second cam and a return element disposed on the reciprocating part, through a revolution space of said second cam area.

9. The apparatus according to claim 8, wherein said flexible element is hooked at said attachment point and at said return element.

10. The apparatus according to claim 8, wherein said flexible element has a finite length.

11. The apparatus according to claim 8, wherein said flexible element is an open-link chain.

12. The apparatus according to claim 1, which comprises a cam follower element resting on said first cam area and holding the reciprocating part at a distance from said second cam area.

13. The apparatus according to claim 12, wherein said cam follower element has a contact surface with convex curvature.

14. The apparatus according to claim 12, wherein said cam follower element is a ceramic material element.

15. The apparatus according to claim 12, wherein said cam follower element has a roller disposed to roll on said first cam area.

16. The apparatus according to claim 12, which further comprises a return element disposed in said cam follower element.

17. The apparatus according to claim 1, wherein the reciprocating part has a drag lever, mounted on a drag lever holder, and a valve, mounted at a free end of said drag lever.

18. The apparatus according to claim 17, which comprises a cam follower element operatively associated with said first cam area and disposed on said drag lever, and a return element is disposed on the valve operated by said free end of said drag lever.

19. A positive-guidance apparatus for conversion of a rotary movement of a drive to a reciprocating movement of a part, the apparatus comprising:

a first cam having formed thereon a first cam area disposed to directly push the part away from a given position resting against the first cam;

a flexible element having an end connected to the part; and a second cam having formed thereon a second cam area disposed to interact with said flexible element to pull the part back solely by way of said flexible element into the given position resting against the first cam; and wherein said first and second cams are commonly formed on a cam element, said cam element has two axially separate, second cam areas and two respectively associated flexible elements, and wherein said first cam area and an associated cam follower element are arranged between said second cam areas.

20. A positive-guidance apparatus for conversion of a rotary movement of a drive to a reciprocating movement of a part, the apparatus comprising:

a first cam having formed thereon a first cam area disposed to directly push the part away from a given position resting against said first cam;

a flexible element having a first end connected to the part and a fixed, stationary end; and a second cam having formed thereon a second cam area disposed to interact with said flexible element between said first end and said stationary end to pull the part back with said flexible element by deflecting the flexible element in a region between said first end and said stationary end.

* * * * *